US011478791B2

(12) United States Patent
Yu et al.

(10) Patent No.: US 11,478,791 B2
(45) Date of Patent: Oct. 25, 2022

(54) FLOW CONTROL AND PROCESSING CARTRIDGE

(71) Applicant: Delta Electronics Int'l (Singapore) Pte Ltd, Singapore (SG)

(72) Inventors: Hao Yu, Singapore (SG); Qian Liang, Singapore (SG)

(73) Assignee: DELTA ELECTRONICS INT'L (SINGAPORE) PTE LTD, Singapore (SG)

( * ) Notice: Subject to any disclaimer, the term of this patent is extended or adjusted under 35 U.S.C. 154(b) by 458 days.

(21) Appl. No.: 16/749,462

(22) Filed: Jan. 22, 2020

(65) Prior Publication Data

US 2020/0156068 A1 May 21, 2020

Related U.S. Application Data

(63) Continuation-in-part of application No. 16/262,539, filed on Jan. 30, 2019, which is a continuation-in-part
(Continued)

(30) Foreign Application Priority Data

Feb. 8, 2018 (SG) ..... 10201801084S
Feb. 8, 2018 (SG) ..... 10201801085V
(Continued)

(51) Int. Cl.
*B01L 3/00* (2006.01)
*B01L 7/00* (2006.01)

(52) U.S. Cl.
CPC ..... *B01L 3/502715* (2013.01); *B01L 3/50273* (2013.01); *B01L 3/502738* (2013.01);
(Continued)

(58) Field of Classification Search
CPC ..... B01L 3/502; B01L 3/502715; B01L 2200/027; B01L 2200/10; B01L 2200/16;
(Continued)

(56) References Cited

U.S. PATENT DOCUMENTS 6,783,736 B1 * 8/2004 Taylor ..... B01L 3/502 422/554
8,048,386 B2 11/2011 Dority et al.
(Continued)

FOREIGN PATENT DOCUMENTS

CN 101675170 A 3/2010
CN 101748212 A 6/2010
(Continued)

*Primary Examiner* — Sharon Pregler
(74) *Attorney, Agent, or Firm* — Kirton McConkie; Evan R. Witt

(57) ABSTRACT

A flow control and processing cartridge includes a cartridge body and a reaction chip. The cartridge body includes plural first chambers and plural first channels for storing and processing at least one of a sample, a reagent and a buffer and configured to perform nucleic acid extraction. The reaction chip is in conjunction with the cartridge body and includes plural second chambers and plural second channels configured to store and process an amplification reaction solution, and at least two fluidic networks configured to perform nucleic acid amplification and detection. One of the fluidic networks includes plural detection wells, a main fluid channel connected with the detection wells and configured to dispense the sample or control liquids into the detection wells, and a gas releasing channel connected with the detection wells and configured to release gas from the detection wells, wherein one of the fluidic networks is configured for quality control.

20 Claims, 20 Drawing Sheets

Related U.S. Application Data of application No. 15/938,082, filed on Mar. 28, 2018, now Pat. No. 10,850,281, which is a continuation-in-part of application No. 15/700,791, filed on Sep. 11, 2017, now Pat. No. 10,654,038, application No. 15/972,957, filed on May 7, 2018, now Pat. No. 11,376,581, which is a continuation-in-part of application No. 15/700,791, filed on Sep. 11, 2017, now Pat. No. 10,654,038.

(60) Provisional application No. 62/393,211, filed on Sep. 12, 2016, provisional application No. 62/393,223, filed on Sep. 12, 2016.

(30) Foreign Application Priority Data

Sep. 28, 2018 (SG) ..... 10201808600T
Jan. 31, 2019 (SG) ..... 10201900939T

(52) U.S. Cl.
CPC ..... *B01L 7/52* (2013.01); *B01L 2200/10* (2013.01); *B01L 2200/143* (2013.01); *B01L 2300/087* (2013.01)

(58) Field of Classification Search
CPC ..... B01L 2300/08; B01L 2300/0803; B01L 3/50273; B01L 3/502738; B01L 3/527; B01L 2400/0487; B01L 2400/0644; B01L 2400/0677
USPC ..... 422/68.1, 500, 502
See application file for complete search history.

(56) References Cited

U.S. PATENT DOCUMENTS

| | | | | |
|---|---|---|---|---|
| 8,441,629 | B2 | 5/2013 | Kolesnychenko et al. | |
| 2004/0053290 | A1 | 3/2004 | Terbrueggen et al. | |
| 2004/0161788 | A1 | 8/2004 | Chen et al. | |
| 2005/0233324 | A1 | 10/2005 | Corbett et al. | |
| 2006/0040303 | A1 | 2/2006 | Weilke | |
| 2006/0204997 | A1 | 9/2006 | Macioszek et al. | |
| 2006/0223061 | A1 | 10/2006 | Corbett et al. | |
| 2007/0154922 | A1 | 7/2007 | Collier et al. | |
| 2008/0153078 | A1 | 6/2008 | Braman et al. | |
| 2010/0056383 | A1 | 3/2010 | Ririe et al. | |
| 2010/0086990 | A1* | 4/2010 | Stanley | B01L 3/502 435/286.1 |
| 2011/0044865 | A1 | 2/2011 | Groisman et al. | |
| 2011/0143968 | A1 | 6/2011 | Chen et al. | |
| 2014/0004621 | A1 | 1/2014 | Dority et al. | |
| 2014/0051062 | A1 | 2/2014 | Vanapalli et al. | |
| 2015/0099291 | A1 | 4/2015 | Ririe et al. | |
| 2015/0135502 | A1 | 5/2015 | Rankin et al. | |
| 2017/0015993 | A1 | 1/2017 | Chen et al. | |

FOREIGN PATENT DOCUMENTS

| | | | |
|---|---|---|---|
| CN | 201884767 | U | 6/2011 |
| CN | 102341710 | A | 2/2012 |
| CN | 102422143 | A | 4/2012 |
| CN | 103424304 | A | 12/2013 |
| CN | 103831140 | A | 6/2014 |
| CN | 104204229 | A | 12/2014 |
| CN | 104630373 | A | 5/2015 |
| CN | 204625604 | U | 9/2015 |
| CN | 103831140 | B | 12/2015 |
| CN | 105316224 | A | 2/2016 |
| CN | 105828945 | A | 8/2016 |
| CN | 106222069 | A | 12/2016 |
| CN | 105940094 | B | 2/2018 |
| EP | 1180135 | B1 | 8/2005 |
| JP | 2012524242 | A | 10/2012 |
| TW | M445583 | U | 1/2013 |
| TW | 201333188 | A | 8/2013 |
| TW | 201617454 | A | 5/2016 |
| TW | 201704477 | A | 2/2017 |
| WO | 9849340 | | 11/1998 |
| WO | 2015057574 | A1 | 4/2015 |

* cited by examiner

4

7

8

8

FLOW CONTROL AND PROCESSING CARTRIDGE

CROSS-REFERENCE TO RELATED APPLICATION

This application is a continuation-in-part of U.S. patent application Ser. No. 15/972,957 filed on May 7, 2018, which claims the priority to Singapore Patent Application No. 10201801084S filed on Feb. 8, 2018 and is a continuation-in-part of U.S. patent application Ser. No. 15/700,791 filed on Sep. 11, 2017, which claims the benefit of U.S. Provisional Application Ser. No. 62/393,211 filed on Sep. 12, 2016 and the benefit of U.S. Provisional Application Ser. No. 62/393,223 filed on Sep. 12, 2016. This application is also a continuation-in-part of U.S. patent application Ser. No. 16/262,539 filed on Jan. 30, 2019, which claims the priority to Singapore Patent Application No. 10201808600T filed on Sep. 28, 2018 and is a continuation-in-part of U.S. patent application Ser. No. 15/938,082 filed on Mar. 28, 2018, which claims the priority to Singapore Patent Application No. 10201801085V filed on Feb. 8, 2018 and is a continuation-in-part of U.S. patent application Ser. No. 15/700,791 filed on Sep. 11, 2017, which claims the benefit of U.S. Provisional Application Ser. No. 62/393,211 filed on Sep. 12, 2016 and the benefit of U.S. Provisional Application Ser. No. 62/393,223 filed on Sep. 12, 2016. This application further claims the priority to Singapore Patent Application No. 10201900939T filed on Jan. 31, 2019. The entirety of each of the aforementioned patent applications is incorporated herein by reference.

FIELD OF THE INVENTION

The present invention relates to a flow control and processing cartridge, and more particularly to a flow control and processing cartridge used in a nucleic acid analysis apparatus.

BACKGROUND OF THE INVENTION

In vitro diagnostics (IVD) are increasingly important in modern medical practices. Recent years due to the demands of rapid diagnostics and decentralization of healthcare facilities, point-of-care-test (POCT) technologies, which enables on site detection with minimized trained technicians and human errors, are widely used in many applications. Generally POCT refers to simple medical tests that can be performed at the bedside, namely at the time and place of patient care, through a special designed device and a disposable test strip or cartridge. Various technologies have been developed to realize POCT including biochemistry, immunology and molecular biology. Among which, molecular based diagnostics is well acknowledged as the most promising candidates of the future market dominator.

Traditional molecular diagnostics is carried out in a central laboratory by well-trained technicians with a group of sophisticated equipment and following a series of predefined protocols. In additional, most central laboratory detections are operated for high throughput only when a large number of samples are collected due to the requirement of overall turnaround time and cost effectivity. Alternatively, POCT platforms integrate these bulk equipments within a desktop or handheld sized device, by emphasizing its portability and flexibility. Most molecular based POCT device have to work with a disposable cartridge when carrying out the diagnostics and virtually a part of functionalities previously existed in its counter-party bulk instruments are removed from the platform and they are incorporated within the fluid circuit in the disposable cartridge development.

As a result, the development of disposable cartridge is of vital importance to the POCT product development. Thus, there is a need of providing a cartridge design used for all-in-one nucleic acid analysis apparatus to realize and improve POCT.

SUMMARY OF THE INVENTION

An object of an embodiment of the present disclosure is to provide a flow control and processing cartridge used in a nucleic acid analysis apparatus to precisely control the flow direction and dynamic flow behaviors in the cartridge, provide on-cartridge processing quality assurance, and provide fluidic processing functions including metering, mixing, debubbling, and dispensing to facilitate the following nucleic acid amplification and detection.

According to an aspect of the embodiment of the present disclosure, there is provided a flow control and processing cartridge used in a nucleic acid analysis apparatus, and the cartridge includes a cartridge body and a reaction chip. The cartridge body includes plural first chambers and plural first channels connected with the plural first chambers for storing and processing at least one of at least one sample, at least one reagent, and at least one buffer and configured to perform at least one of sample purification and nucleic acid extraction. The reaction chip is in conjunction with the cartridge body and includes plural second chambers and plural second channels connected with the plural second chambers configured to store and process at least one amplification reaction solution, and at least two fluidic networks configured to perform nucleic acid amplification and detection. At least one of the fluidic networks includes plural detection wells, a main fluid channel connected with the detection wells and configured to dispense the sample or control liquids into the detection wells, and a gas releasing channel connected with the detection wells and configured to release gas from the detection wells, wherein one of the fluidic networks is configured for quality control.

In an embodiment, parts of the second chambers and parts of the second channels of the reaction chip jointly form a metering unit. The metering unit includes a storage chamber, at least one metering chamber, an overflow chamber, and channels connecting the storage chamber, the metering chamber, and the overflow chamber.

In an embodiment, parts of the second chambers and parts of the second channels of the reaction chip jointly form a mixing and debubbling unit. The mixing and debubbling unit includes a storage chamber, a mixing chamber, a mixture chamber, a ball contained in the mixing chamber, and channels connecting the storage chamber, the mixing chamber, and the mixture chamber. The mixing chamber has a bottom hole, and the ball lays on the bottom hole as a single-direction valve to block the bottom hole when the at least one amplification reaction solution is delivered into the mixing chamber.

In an embodiment, a mixing function of the mixing and debubbling unit is implemented by pumping air into the amplification reaction solution contained in the mixing chamber to agitate the amplification reaction solution.

In an embodiment, a debubbling function of the mixing and debubbling unit is implemented by pumping air into the mixing chamber to pressurize the air and break bubbles in the amplification reaction solution.

In an embodiment, the flow control and processing cartridge further includes a thermal treatment chip in conjunction with the cartridge body.

The above objects and advantages of the embodiments of the present disclosure become more readily apparent to those ordinarily skilled in the art after reviewing the following detailed description and accompanying drawings, in which:

DETAILED DESCRIPTION OF THE PREFERRED EMBODIMENT

Figure 1:
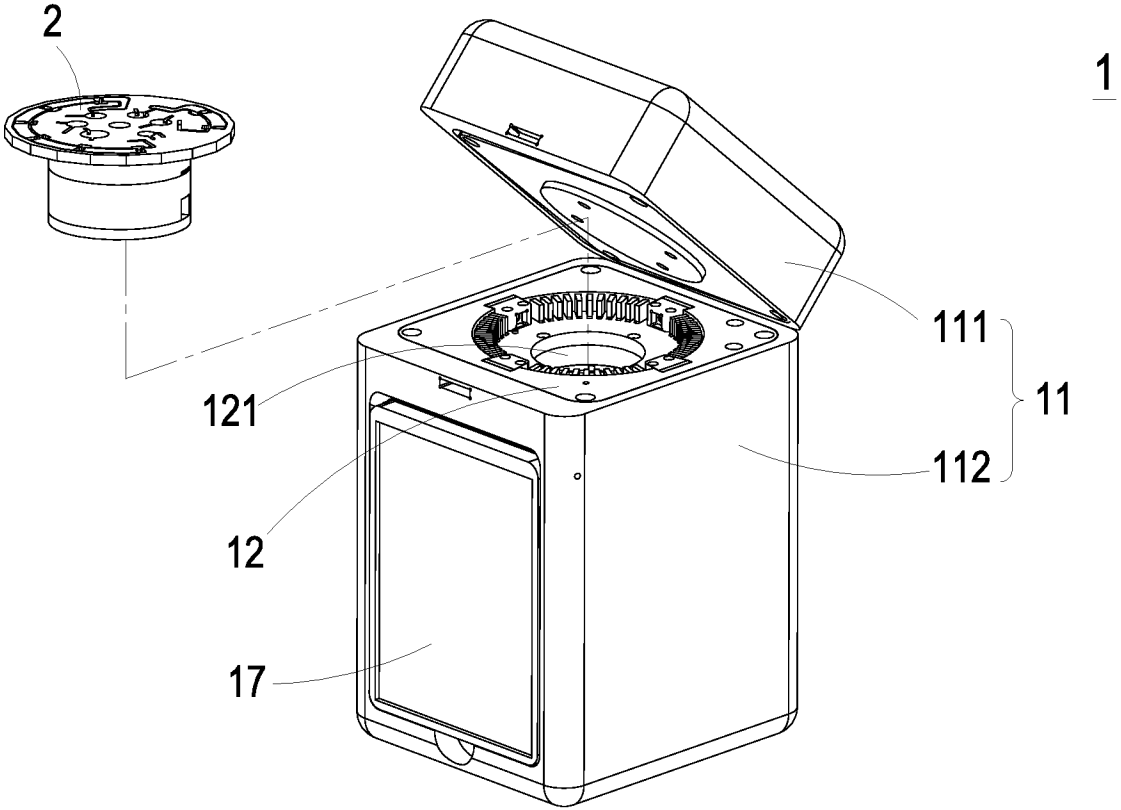
FIGS. 1 and 2 show schematic views of the nucleic acid analysis apparatus according to an embodiment of the present disclosure.

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly. When an element is referred to as being "connected," or "coupled," to another element, it can be directly connected or coupled to the other element or intervening elements may be present. In addition, although the "first," "second," "third," and the like terms in the claims used to describe the various elements can be appreciated, these elements should not be limited by these terms, and these elements are described in the respective embodiments are used to express the different reference numerals, these terms are only used to distinguish one element from another element. For example, a first element could be termed a second element, and, similarly, a second element could be termed a first element, without departing from the scope of example embodiments. Besides, "and/or" and the like may be used herein for including any or all combinations of one or more of the associated listed items. While the numerical ranges and parameters set forth for the broad scope of the present invention are approximations, the numerical value reported in the specific examples set forth as accurately as possible. However, any numerical values inherently contain certain errors necessarily the standard deviation found in the respective testing measurements caused. Also, as used herein, the term "about" or "substantially" generally means away from a given value or a range of 10%, 5%, 1% or 0.5%. Alternatively, the word "about" or "substantially" means within an acceptable standard error of ordinary skill in the art-recognized average. In addition to the operation/working examples, or unless otherwise specifically stated otherwise, in all cases, all of the numerical ranges, amounts, values and percentages, such as the number for the herein disclosed materials, time duration, temperature, operating conditions, the ratio of the amount, and the like, should be understood as the word "about" or "substantially" decorator. Accordingly, unless otherwise indicated, the numerical parameters of the present invention and scope of the appended patent proposed is to follow changes in the desired approximations. The number of significant digits for each numerical parameter should at least be reported and explained by conventional rounding technique is applied. Herein, it can be expressed as a range between from one endpoint to the other or both endpoints. Unless otherwise specified, all ranges disclosed herein are inclusive.

The embodiment of the present disclosure provides a flow control and processing cartridge used in a nucleic acid analysis apparatus. The nucleic acid analysis apparatus is an all-in-one nucleic acid analysis apparatus, which integrates a fluid delivery unit, a thermal unit, a driving unit, and at least one optical unit on one single device, and the processes of sample purification, nucleic acid extraction, nucleic acid amplification, and nucleic acid detection can be performed on the all-in-one apparatus to realize nucleic acid analysis in real time.

Figure 2:
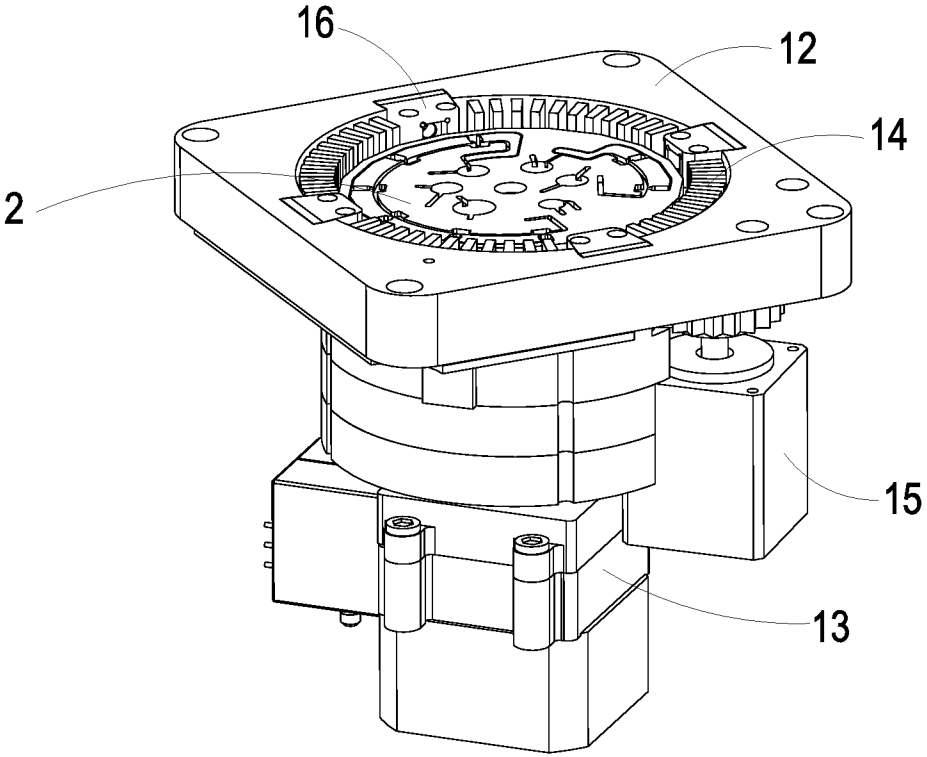

FIGS. 1 and 2 show schematic views of the nucleic acid analysis apparatus according to an embodiment of the present disclosure, wherein the nucleic acid analysis apparatus in FIG. 1 is opened, the cartridge is moved out of the nucleic acid analysis apparatus, the outer casing of the nucleic acid analysis apparatus is removed, and the rest components such as wires, tubing connection, and printed circuit board (PCB) are not illustrated in FIG. 2 for a better viewing purpose. As shown in FIGS. 1 and 2, the nucleic acid analysis apparatus 1 includes a casing 11, a main frame 12, a fluid delivery unit 13, a thermal unit 14, a driving unit 15, and at least one optical unit 16, wherein the casing 11 includes an upper casing 111 and a lower casing 112, and the main frame 12 is disposed in the lower casing 112. The main frame 12 has a chamber 121 specifically designed for mounting a flow control and processing cartridge 2 therein. The fluid delivery unit 13 is connected with the main frame 12 and configured to transport fluid within the flow control and processing cartridge 2 for at least one of sample purification, nucleic acid extraction, amplification, and detection. Generally, sample purification may also be partial procedure of nucleic acid extraction. The thermal unit 14 is disposed on the main frame 12 and configured to provide a predefined temperature for nucleic acid amplification. The driving unit 15 is connected with the main frame 12 and capable of attaching the flow control and processing cartridge 2 conformally with the fluid delivery unit 13 during sample purification and/or nucleic acid extraction and rotating the flow control and processing cartridge 2 with a predefined program during nucleic acid amplification and/or detection. The at least one optical unit 16 is disposed on the main frame 12 and includes plural optical components for detection, such as nucleic acid detection or sample reaction detection.

In an embodiment, the nucleic acid analysis apparatus 1 further includes a touch screen 17 disposed on the lower casing 112 for user operation and results showing. Since the lower casing 112 is enlarged, the size of the touch screen 17 could also be enlarged. Compared to the top-mounted touch screen, the touch screen 17 on the nucleic acid analysis apparatus 1 could be increased to larger sizes. In addition, the touch screen 17 is designed to have adjustable operation angles to facilitate user's viewing and operation.

For example, the fluid delivery unit 13, the thermal unit 14, the driving unit 15, and the optical unit 16 of the nucleic acid analysis apparatus 1 are similar to those disclosed in U.S. patent application Ser. No. 16/262,539 filed on Jan. 30, 2019, which claims the priority to Singapore Patent Application No. 10201808600T filed on Sep. 28, 2018 by the applicant of the present disclosure, the entire contents of which are incorporated herein by reference and are not redundantly described here.

Particularly, the flow control and processing cartridge 2 provided in the embodiment of the present disclosure could precisely control the flow direction and dynamic flow behaviors therein, provide on-cartridge processing quality assurance, and provide fluidic processing functions including at least one of metering, mixing, debubbling, and dispensing to facilitate the following nucleic acid amplification and detection, and the detailed structures of the flow control and processing cartridge 2 (hereinafter referred as cartridge 2) will be illustrated as follows.

Figure 3:
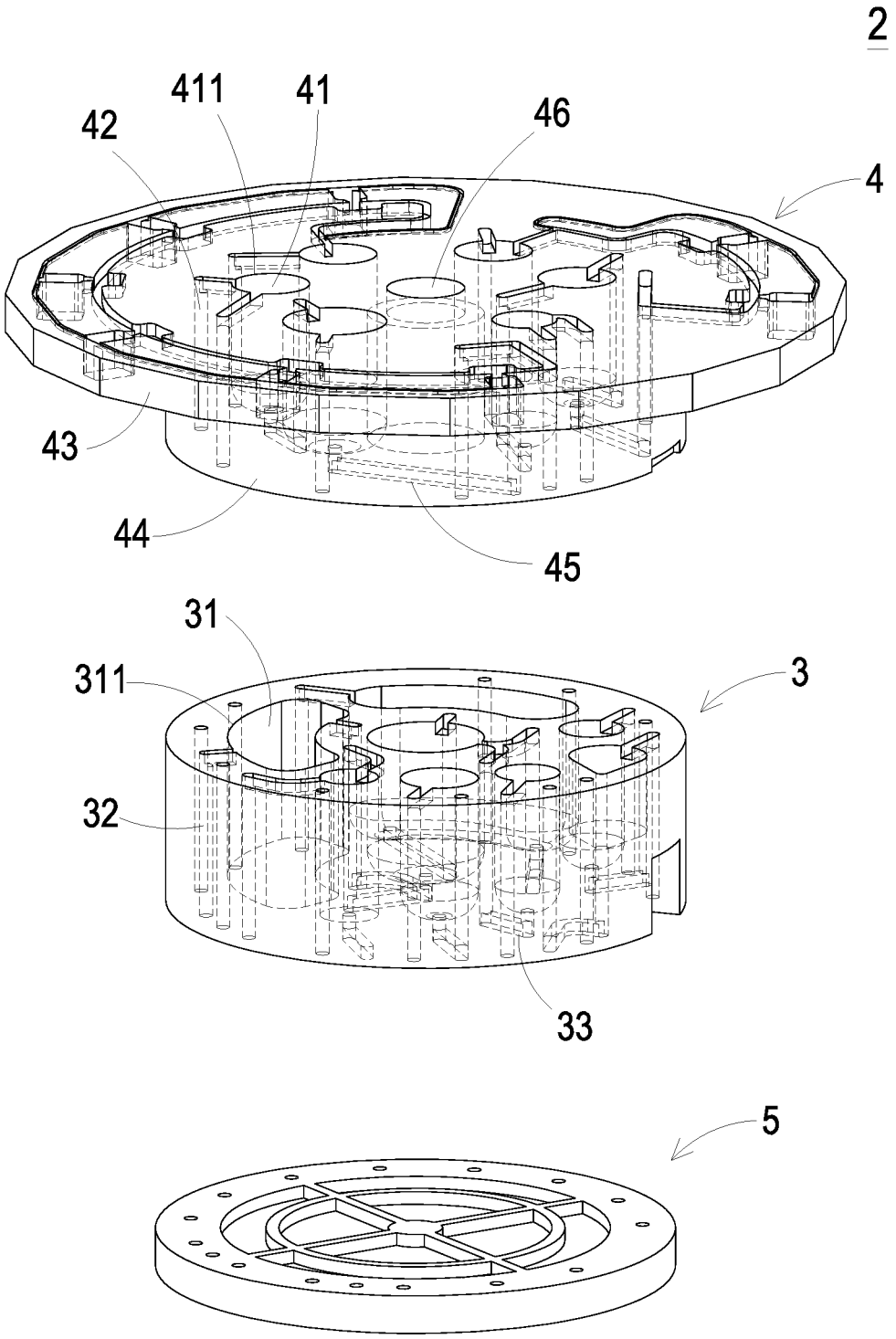
FIG. 3 shows an exploded view of the cartridge according to an embodiment of the present disclosure.
Figure 4:
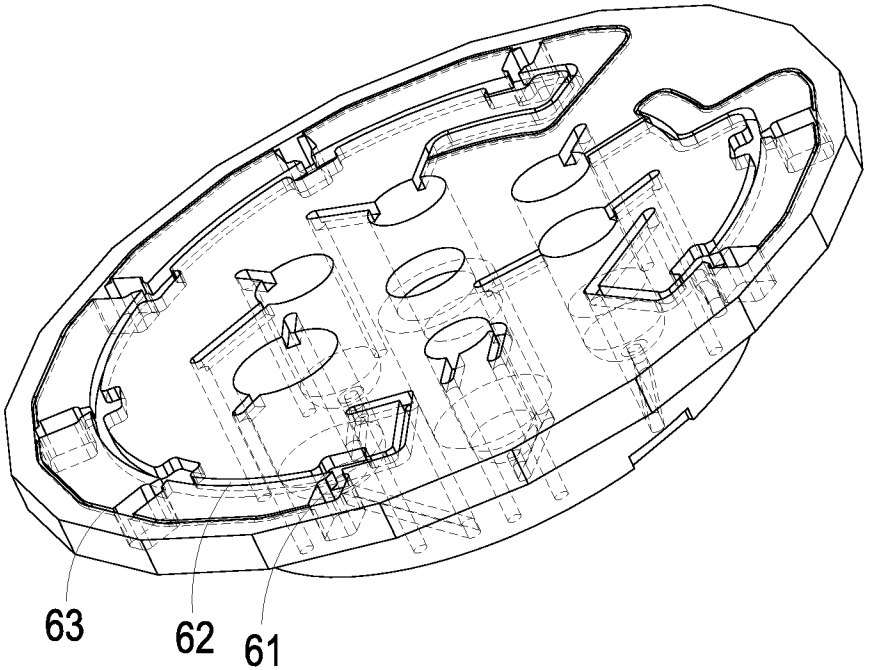
FIGS. 4 to 6 show different views of the reaction chip of the cartridge.
Figure 5:
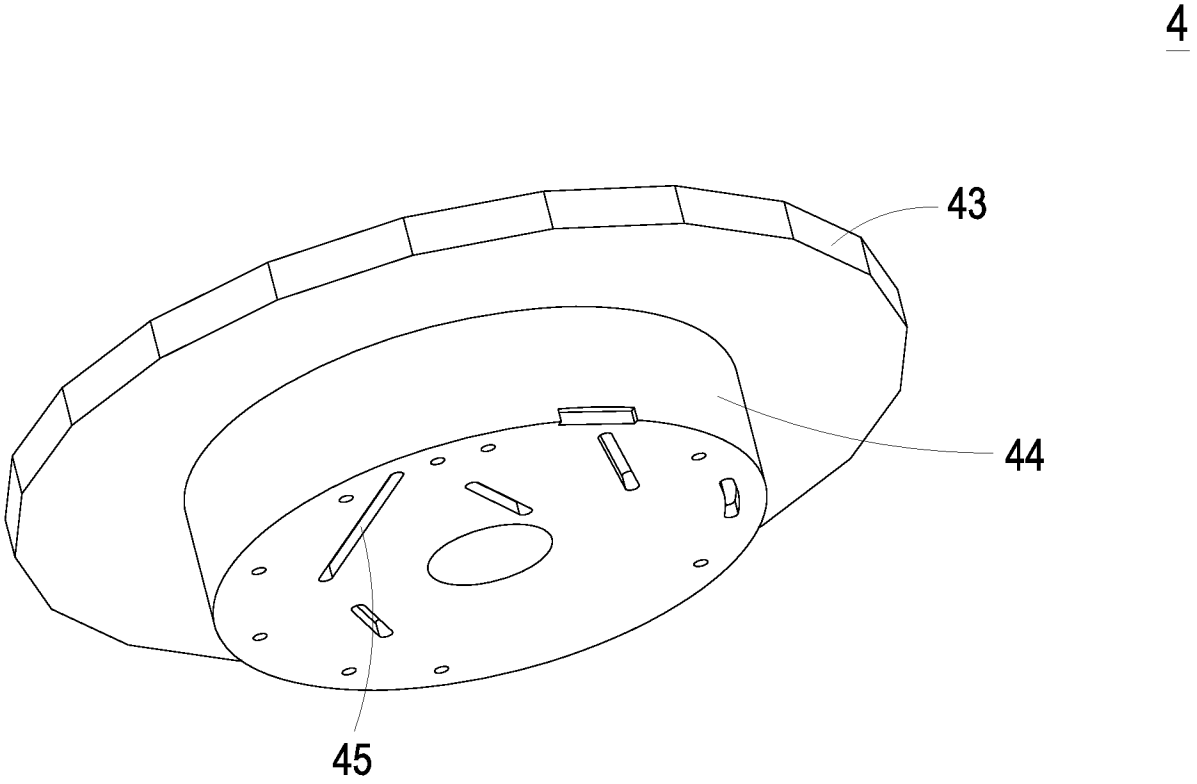
Figure 6:
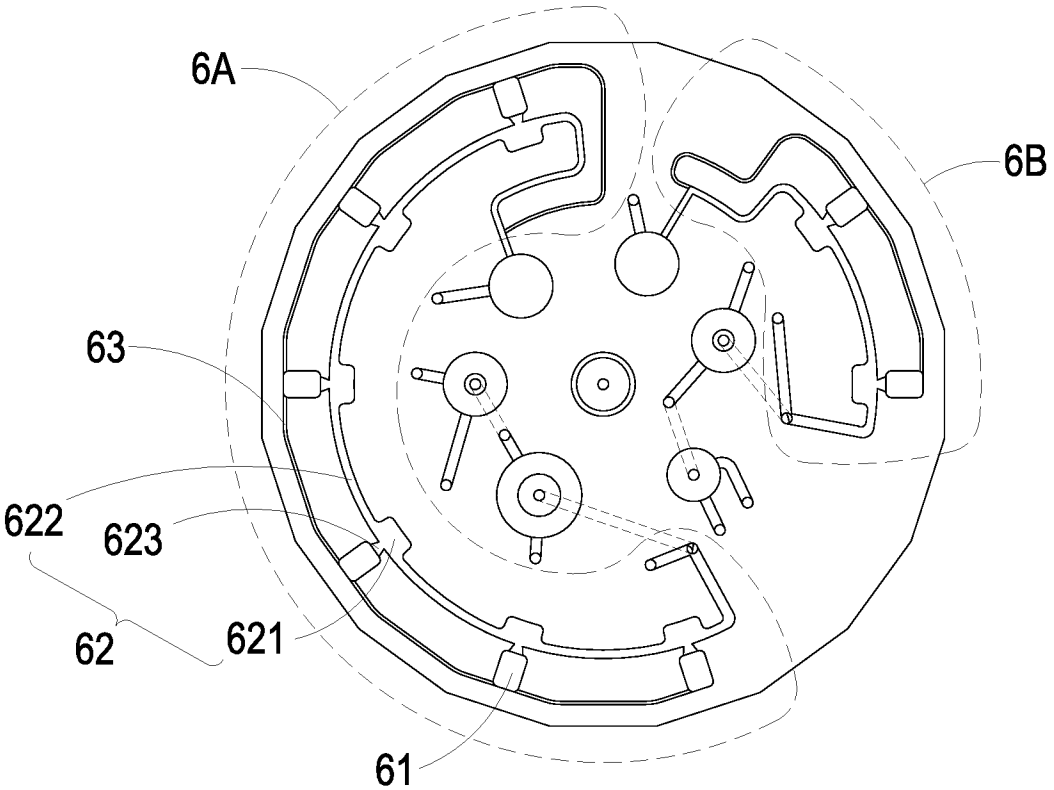

FIG. 3 shows an exploded view of the cartridge according to an embodiment of the present disclosure, and FIGS. 4 to 6 show different views of the reaction chip of the cartridge. The cartridge 2 at least includes a cartridge body 3 and a reaction chip 4. The cartridge body 3, also referred as extraction chip, includes plural first chambers 31 and plural first channels 32 connected with the plural first chambers 31 for storing and processing at least one of at least one sample, at least one reagent, and at least one buffer and configured to perform at least one of sample purification and nucleic acid extraction. In the embodiment, the cartridge body 3 includes plural first chambers 31 and plural first channels 32 connected with the plural first chambers 31 for storing and processing at least one sample and plural reagents and buffers and configured to perform at least one of sample purification and nucleic acid extraction. The reaction chip 4 is in conjunction with the cartridge body 3 and includes plural second chambers 41 and plural second channels 42 connected with the plural second chambers 41. The plural second chambers 41 and plural second channels 42 are configured to store and process at least one amplification reaction solution. The reaction chip 4 further includes at least two separate fluidic networks 6A and 6B configured to perform nucleic acid amplification and detection, wherein one of the fluidic networks 6A and 6B is configured for quality control.

The reaction chip 4 includes a planar portion 43 and a column portion 44. The column portion 44 is extended from the bottom of the planar portion 43 and has a smaller cross-section than the planar portion 43. In an embodiment, the column portion 44 is a cylindrical body, and the planar portion 43 and the column portion 44 are integrally formed. The second chambers 41 of the reaction chip 4 have top openings 411 at the top surface of the planar portion 43. The second channels 42 of the reaction chip 4 include fluidic channels and pneumatic channels. The fluidic channels may include planar channels and vertical channels connected to the second chambers 41 and the fluidic networks 6A and 6B for delivering liquids therein. The pneumatic channels may include planar channels and through-hole channels connected to the second chambers 41, the fluidic networks 6A and 6B, and the fluid delivery unit 13 for introduction of external air to push and deliver liquids in the cartridge 2. The reaction chip 4 further includes plural bottom openings 45 at the bottom surface of the column portion 44, and the bottom openings 45 may be served as planar fluidic channels communicated with the second chambers 41, the second channels 42, and the fluidic networks 6A and 6B for fluid delivery. The shape of the bottom openings 45 may be but not limited to circular, rectangular or other regular or irregular shape.

In some embodiments, the second chambers 41 of the reaction chip 4 may function as at least one of storage chamber, waste chamber, metering chamber, and mixing chamber, but not limited thereto. The storage chamber may be used for storing amplification reagents, e.g. master mix, and the waste chamber may be used for containing residual or wasted liquids, e.g. excess mineral oil produced during fluidic processing. The second chambers 41 may be any shape, including but not limited to round, square, triangle, rectangular or oval. The dimension of each chamber depends on the volume of each particular reagent to be stored or each particular mixture or solution to be processed.

The reaction chip 4 includes at least one sample loading port 46 on the top surface thereof for introducing at least one sample into the cartridge 2. The number of the sample loading port 46 depends on the number of sample to be diagnosed in the cartridge 2. The position of the sample loading port 46 is flexible in design, for example, at the central position or at a margin position. In one embodiment, the sample, including but not limited to buccal swab, can be inserted through the sample loading port 46 and reach the sample preparation chamber in the cartridge body 3. In one embodiment, the sample, including but not limited to whole blood, can be pipetted through the sample loading port 46 and contained in the sample preparation chamber in the cartridge body 3. In some embodiments, there is a cap made of biocompatible material to enclose the sample loading port 46 after the sample is loaded into the cartridge 2, in order to eliminate contamination to the diagnostic system.

The sample loading port 46 is communicated with one of the plural first chambers 31 in the cartridge body 3, so as to store the sample in the cartridge body 3. Biochemical reagents and buffers for sample purification and/or nucleic acid extraction are pre-loaded within the first chambers 31 of the cartridge body 3 through top openings 311. The first channels 32 of the cartridge body 3 may include fluidic channels and pneumatic channels. The fluidic channels may include planar channels and vertical channels connected to the first chambers 31 for delivering liquids therein. The pneumatic channels may include planar channels and through-hole channels connected to the first chambers 31 and the fluid delivery unit 13 for introduction of external air to push and deliver liquids in the cartridge 2. The cartridge body 3 further includes plural bottom openings 33 at the bottom surface of the cartridge body 3, and the bottom openings 33 are communicated with the first chambers 31 and the first channels 32 for fluid delivery. The shape of the bottom openings 33 may be but not limited to circular, rectangular or other regular or irregular shape.

In an embodiment, the cartridge body 3 is a cylindrical body, and the diameter of the cartridge body 3 is substantially the same as that of the column portion 44 of the reaction chip 4. The reaction chip 4 may be pre-assembled with the conjunct cartridge body 3 during mass production, by using but not limited to snap fitting, thermal bonding, solvent bonding, adhesive bonding, ultrasonic bonding, laser welding, or any combinations of the above-mentioned.

After the nucleic acid extraction is completed in the cartridge body 3, the sample with extracted nucleic acid is delivered to the reaction chip 4 for following nucleic acid amplification and detection. The second chambers 41 of the reaction chip 4 are provided to contain at least one amplification reaction solution, such as at least one amplification reagent, either in liquid form, in dry form or in miscellaneous forms. In some embodiments, if some sensitive amplification reagents in liquid form, e.g. master mix with enzymes, are contained in the second chambers 41, it is preferred to store the reaction chip 4 at −20 degree Celsius in order to preserve the biological activity of the enzymes. For these cases, the other reagents used for amplification except master mix with enzymes, can then be stored in the first chambers 31 of the cartridge body 3 at ambient temperature, and can be delivered upwards to the reaction chip 4 for further fluidic processing on demand. In some embodiments, some sensitive amplification reagents are produced or provided in dry form, e.g. lyophilized master mix beads, in order to extend shelf-life and ease storage and transportation requirements. For these circumstances, the reaction chip 4 containing these dry form sensitive reagents can be stored at ambient temperature.

Figure 7:
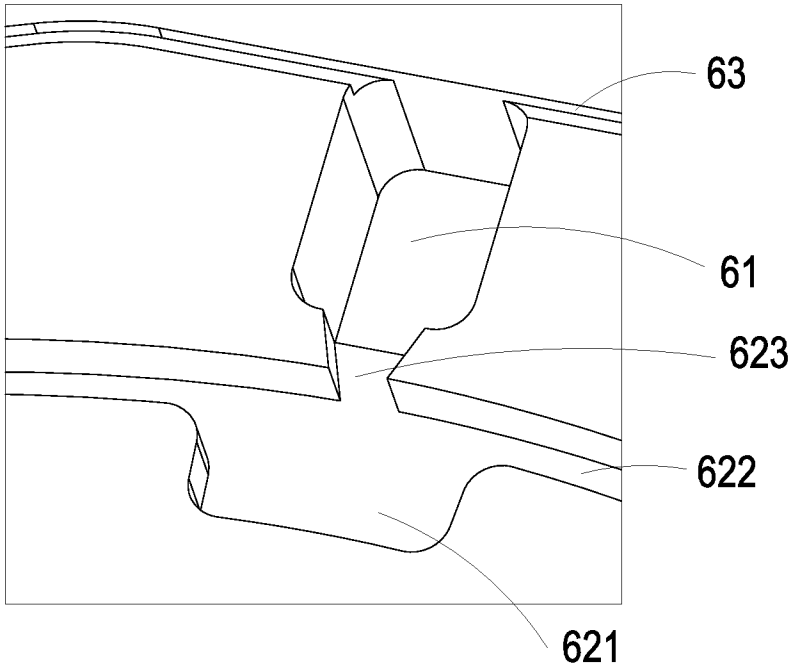
FIG. 7 shows a partially enlarged view of the detection well.

Please refer to FIGS. 4 to 7, wherein FIG. 7 shows a partially enlarged view of the detection well. As shown in FIGS. 4 to 7, the reaction chip 4 includes at least two fluidic networks 6A and 6B configured to perform nucleic acid amplification and detection, wherein one of the fluidic networks 6A and 6B is configured for quality control. For example, the longer fluidic network 6A is a sample fluidic network used for detecting nucleic acid extracted from the sample, while the shorter detecting fluidic network 6B is a control fluidic network used for positive control liquid and negative control liquid. In some embodiments, at least one of the fluidic networks 6A and 6B includes plural detection wells 61 for containing the sample and/or the control liquids, a main fluid channel 62 connected with the detection wells 61 and configured to dispense the sample and/or control liquids into the detection wells 61, and at least one gas releasing channel 63 connected with the detection wells 61 and configured to release gas from the detection wells 61. In the embodiment, each of the fluidic networks 6A and 6B includes plural detection wells 61 for containing the sample and/or the control liquids, a main fluid channel 62 connected with the detection wells 61 and configured to dispense the sample and/or the control liquids into the detection wells 61, and at least one gas releasing channel 63 connected with the detection wells 61 and configured to release gas from the detection wells 61.

The number of the detection wells 61 is not limited, and the apparatus could perform multiplexing nucleic acid analysis. In an embodiment, the shape of the planar portion 43 of the reaction chip 4 may be substantially a regular polygon, so that the reaction chip 4 has plural planar side surfaces to be in line with the optical unit 16 to facilitate light focusing. The number of planar side surfaces depends on the number of detection wells 61. Certainly, the shape of the reaction chip 4 is not limited to the regular polygon and it may also be circular or other shape, since the light could be focused on the sample or the control liquids in the detection well 61 by the arrangement of optical components of the optical unit 16.

In an embodiment, each of the detection wells 61 has at least one planar surface. For example, the detection well 61 may be rectangular-shaped and have one planar surface in line with a light source of the optical unit 16 and another planar surface in line with an optical detector of the optical unit 16, respectively, during nucleic acid detection.

During the operation, once the sample is loaded, the cartridge 2 is placed into the nucleic acid analysis apparatus 1, and the flow processing is carried out by the fluid delivery unit 13. The fluid delivery unit 13 works concurrently with the cartridge 2 to carry out the fluid delivery for sample purification, nucleic acid extraction, amplification, and detection so as to have a fully automatic device. The fluid delivery could be realized by but not limited to pneumatic, vacuum, plunger, chamber deformation, thermal-induced expansion, acoustics, centrifugal force or other methods as long as the sample processing is completed within the cartridge 2.

In order to uniformly dispense the sample into the detection wells 61 and fully fill the detection wells 61 without gas bubble trapped, the main fluid channel 62 is specifically designed. As shown in FIGS. 4 and 6, the main fluid channel 62 includes plural wide channel parts 621, plural narrow channel parts 622, and plural well inlet channels 623. Each wide channel part 621 is aligned with a detection well 61 and connected with the detection well 61 through the corresponding well inlet channel 623, and each narrow channel part 622 is connected between two adjacent wide channel parts 621. Once the liquid sample is introduced into the fluidic network 6A, for example, by pressure difference, the liquid first fills the wide channel part 621 corresponding to the first detection well 61. Subsequently, the liquid further flows along the main fluid channel 62 and is retarded because of high flow resistance resulted from the suddenly shrunken channel cross-section. Meanwhile, the liquid enters the detection well 61 through the well inlet channel 623, and the residual gas in the detection well 61 is pushed out by the incoming flow from a gas releasing channel 63 towards the neighboring detection wells 61. Because the channel surfaces are originally or treated to be relatively hydrophobic, the surface tension within the tiny channel essentially repels the liquid from flowing into it. As the gas releasing channel 63 is much narrower than all other channels 621, 622 and 623, the liquid can hardly enters into the gas releasing channel 63. Therefore, residual gas existing at the gas releasing channel 63 also isolates each detection well 61 and prevents the sample from contamination between neighboring detection wells 61. Once the detection well 61 is fully filled, the flow overcomes the flow resistance of the narrow channel part 622 and then reaches the next wide channel part 621 corresponding to the next detection well 61. As a result, the next detection well 61 is filled, and these actions repeat until all the detection wells 61 are fully filled in sequence. Finally, the residual liquid is withdrawn from the main fluid channel 62 and delivered to a waste chamber, and an immiscible fluid, such as oil or liquid wax, is pumped into the main fluid channel 62 subsequently. During this step, the well inlet channel 623 serves as a capillary valve and prevents the sample from flowing out of the detection well 61. As a result, the detection wells 61 filled with purified samples are isolated, and they are sealed by the immiscible fluid to avoid contamination from each other and prevent sample evaporation during the amplification process.

In an embodiment, as shown in FIG. 7, the well inlet channel 623 has a larger cross-sectional area and lower flow resistance on one end connected with the detection well 61, and a smaller cross-sectional area and higher flow resistance on the other end far away from the detection well 61. The well inlet channel 623 may orient the liquid towards the end with lower flow resistance, facilitate liquid to flow into the detection well 61, and restrict liquid flowing backwards. Therefore, the well-to-well cross-contamination caused by backflow from the detection well 61 may be effectively reduced or eliminated.

In an embodiment, the gas releasing channel 63 may be directly connected with each detection well 61 without branches and substantially in a circular shape. Further, a last section of the gas releasing channel 63 connects the last detection well 61 and the channel towards the waste chamber for gas releasing of the last detection well 61.

In a fluidic circuit, the overall flow resistance follows Ohm's law. For example, when the liquid flows through the wide channel part 621 and is entering the narrow channel part 622, the high flow resistance at the narrow channel part 622 significantly retards the majority of the flow speed and therefore the flow switches to a low resistance path at the well inlet channel 623. The flow resistance at the narrow channel part 622 is higher than the combined flow resistance at the wide channel part 621 and at the well inlet channel 623, and generally, the former is 2 to 20 times higher than the latter. As the gas viscosity is normally thousand times lower than that of the liquid, the gas related flow resistances are negligible compared with the resistances of the same channels filled with the liquid. When withdrawing the flow after well dispensing, the flow speed could be well-controlled so that the capillary force plays a role to stop the flow at the well inlet channel 623.

Once the dispensed sample occupies the detection well 61, the gas originally in the detection well 61 is repelled toward the neighboring detection well 61 through the gas releasing channel 63. In order to minimize the liquid overflow into the gas releasing channel 63, the cross-section of the gas releasing channel 63 is much smaller than all other channels. Namely, the gas releasing channel 63 is designed for releasing gas and with extremely high flow resistance for liquid flow, so the gas releasing channel 63 is selectively passing gas while rejecting liquid flow. Generally, the flow resistance at the gas releasing channel 63 is 2 to 500 times higher than the flow resistance at the narrow channel part 622. Under this condition, driven by the external driven pressure, the flow may slowly pass through the narrow channel part 622 and then arrive at the entrance of the next detection well 61. Because the path at the gas releasing channel 63 is interrupted, the only direction to fill the next detection well 61 is though the well inlet channel 623 at the next detection well 61.

In the embodiment, the fluidic network 6B may have the same channel geometry as the fluidic network 6A. That is to say, the fluidic network 6B also includes the detection wells 61, the main fluid channel 62 with wide channel parts 621, narrow channel parts 622 and well inlet channels 623, and the gas releasing channel 63. The fluidic network 6B may have less detection wells 61. In an embodiment, the fluidic network 6B may have two detection wells 61, one of which serves as a positive control well and the other of which serves as a negative control well, for on-cartridge processing quality assurance.

Figure 8:
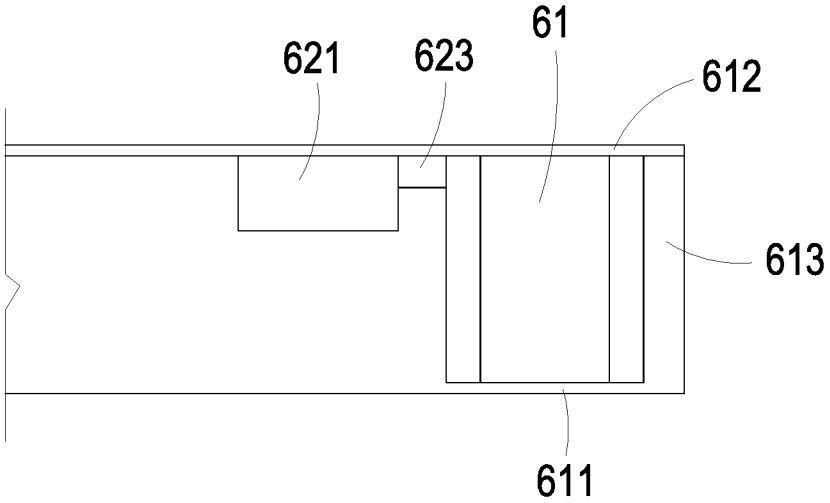
FIG. 8 shows a cross-sectional view of the detection well.

In some embodiments, each detection well 61 has a volume from 1 μL to 200 μL. The detection well 61 is designed to facilitate the optical detection. FIG. 8 shows a cross-sectional view of the detection well. The sample is dispensed from the wide channel part 621 and charged to the detection well 61 through the well inlet channel 623. The well inlet channel 623 has a much smaller cross-section than the wide channel part 621 in order to have a capillary valve for passive flow controlling. In some embodiments, the detection well 61 has a thin wall 611 at the bottom during manufacturing, and the top of the reaction chip 4 is sealed with a thin film 612 to have an enclosed well. In some embodiments, the reaction chip 4 has through detection wells 61 and they are sealed by a top thin film 612 and a bottom thin film 611. In some embodiments, the detection well 61 includes at least one light transmissive thin wall or thin film for passing light therethrough. In some embodiments, at least one of the bottom and the top of the detection well 61 includes a light transmissive thin wall or thin film for passing light therethrough. At the same time, the detection well 61 may have an optical front wall 613 for passing light therethrough, so the fluorescent signal emitted from the sample could transmit through the front wall 613 of the detection well 61 with less loss and maintain a high signal-to-noise ratio (S/N ratio).

In each detection well 61, dry form reagents, e.g. primers, probes, plasmid or other types of nucleotides, may be pre-dispensed so that each well may be served as an independent reaction unit for each specific detection. The number of the detection wells 61 in the fluidic network 6A is not limited, and it depends on the number of detection targets or the panel size of each sample. In some embodiments, each of the fluidic network 6A for sample detection includes 2 to 100 sample detection wells 61. The number of detection wells 61 in the fluidic network 6B is not limited to two, and more control wells can be included for other types of external process controls required for in-vitro diagnostics. In some embodiments, the reaction chip 4 is flexible in design, to accommodate configuration variation of sample throughput and sample target number, or correspondingly the number of fluidic networks and the number of wells in each fluidic network.

Figure 9B:
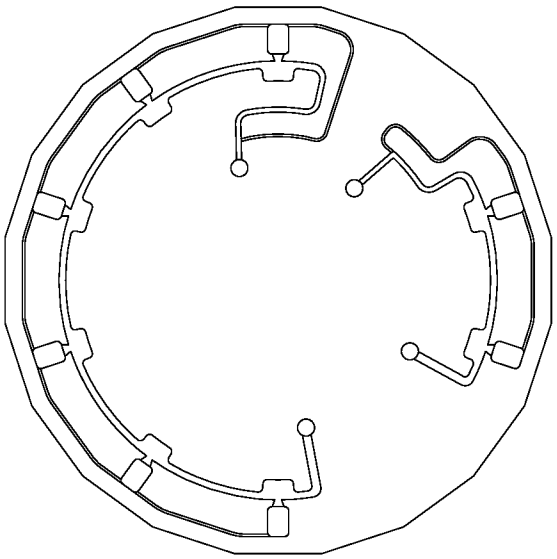
FIGS. 9A to 9D show variation of detection well layout configurations of the reaction chip.
Figure 9A:
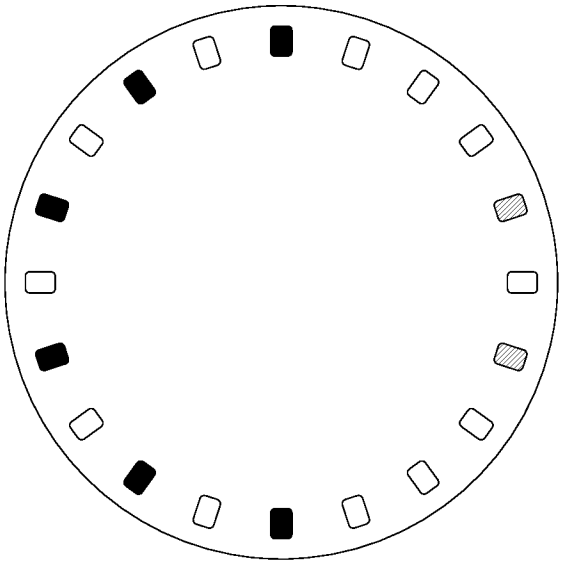
Figure 9D:
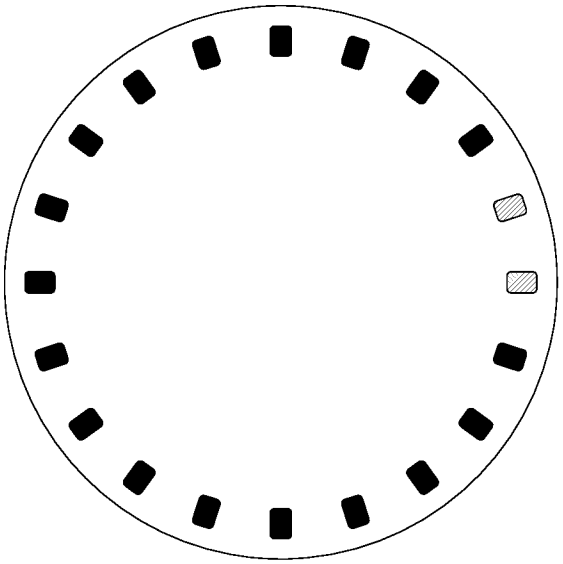
Figure 9C:
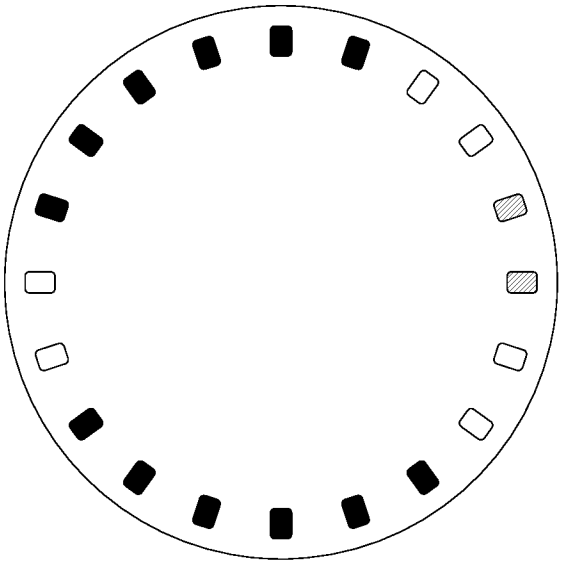

In some embodiments, the number of fluidic networks can be more than two. Among these fluidic networks, one fluidic network may be configured for quality control, and the rest fluidic networks may be used for sample detection. The number of fluidic networks used for sample detection in one reaction chip depends on the number of samples to be diagnosed in the cartridge. FIGS. 9A to 9D show variation of detection well layout configurations of the reaction chip. As shown in FIGS. 9A to 9D, the footprint of each reaction chip 4 includes 20 detection wells 61 in total. For 1-sample chip as shown in FIG. 9A, if 6 detection wells are sufficient for diagnosing a specific sample, 6 of the 20 wells indicated in black, are used as sample wells, while 2 of the 20 wells indicated in grey, are used as control wells. It is possible to manufacture the rest 12 wells as idle wells, or it is actually unnecessary to manufacture them at all, as illustrated in FIG. 9B. Likewise, for higher throughput, for example 2 or 3 samples need to be diagnosed in one chip, 12 or 18 of the 20 wells indicated in black, are used as sample wells, as illustrated in FIGS. 9C and 9D. Moreover, if a larger detection panel size is required for one specific sample, 18 of the 20 wells indicated in black can be used in one sample fluidic network, as illustrated in FIG. 9D.

Therefore, the cartridge 2 may be X-in-one cartridge which means X samples per detection. In an embodiment of three-in-one cartridge, the reaction chip 4 includes three sample loading ports 46 for adding three different samples into the same cartridge 2. While inside the cartridge body 3 and the reaction chip 4, the overall space is divided into three subparts, and each subpart is in charge of one sample processing and detection. In some embodiments, the subparts may share some common chambers, such as waste chamber. Therefore, the X-in-one cartridge allows a flexible throughput when a single cartridge is mounted in the nucleic acid analysis apparatus 1. Users can add several different samples into one cartridge 2 without changing the apparatus, so as to have flexible throughput (1~X) without increasing hardware cost. This is an easy and cost-effective solution for small and medium throughout by using the present cartridge and apparatus.

Figure 10:
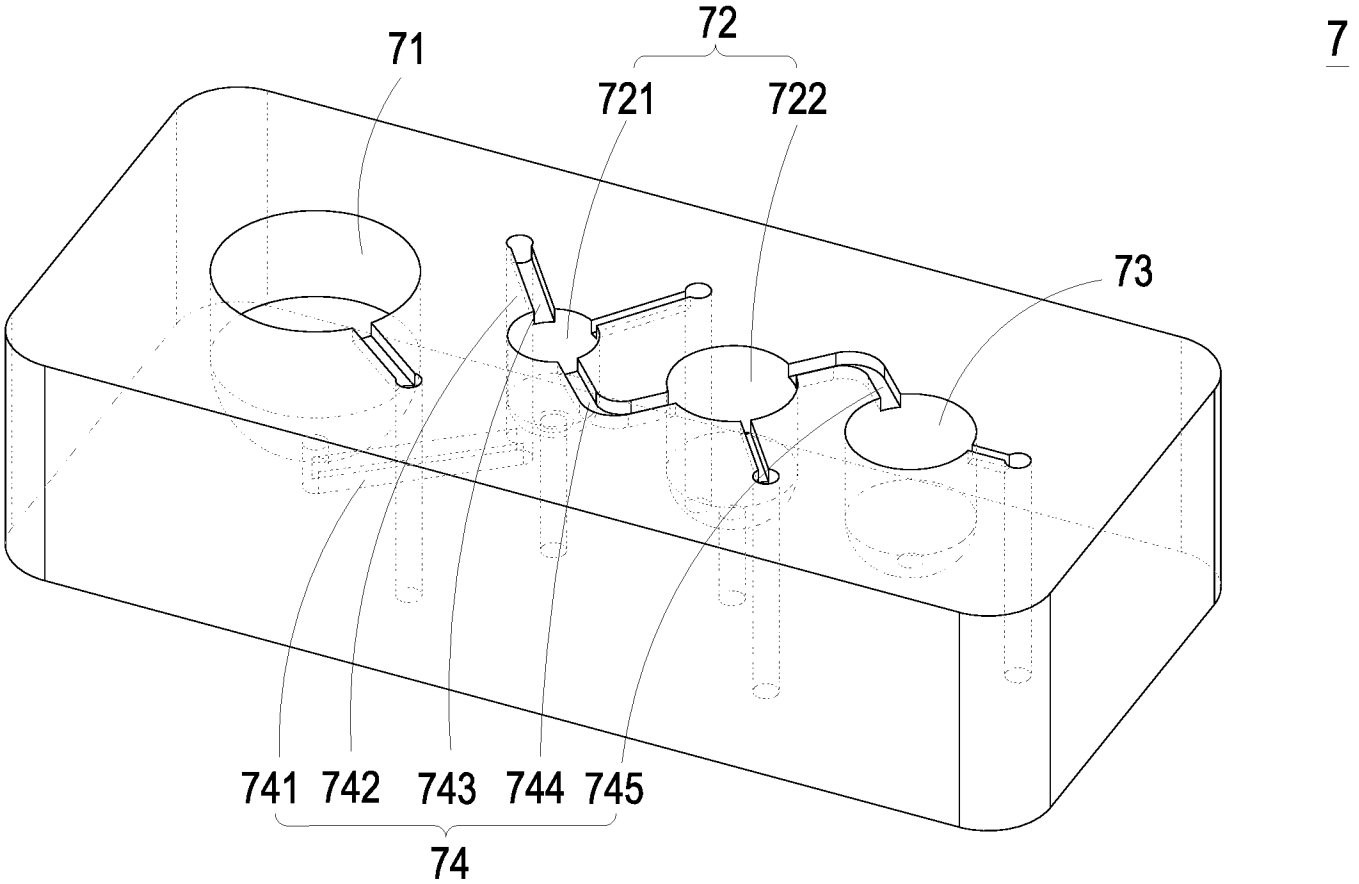
FIGS. 10 to 12 show different views of the metering unit on the reaction chip.
Figure 11:
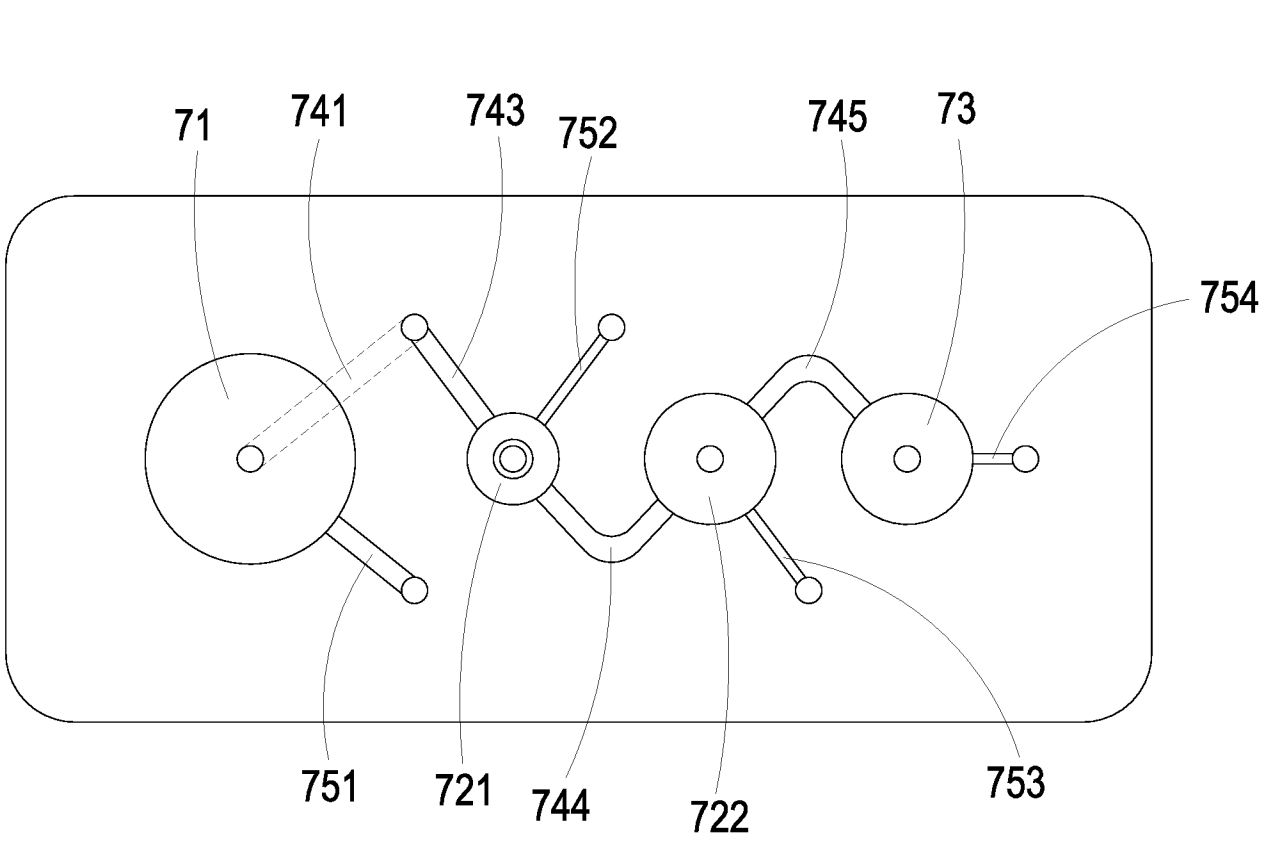
Figure 12:
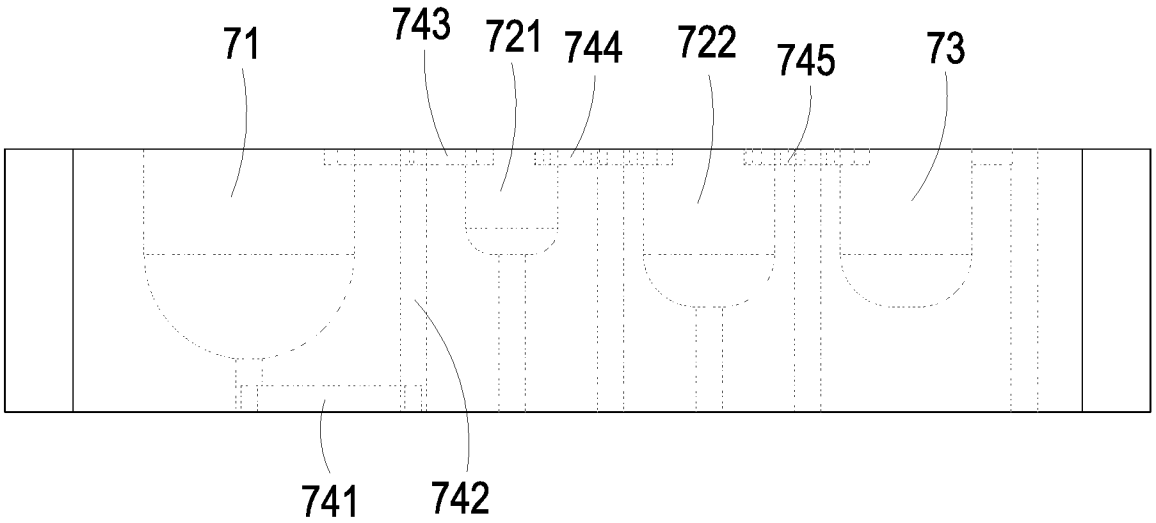

In some embodiments, the second chambers 41 and the second channels 42 of the reaction chip 4 can also perform various fluidic functions used in fluidic processing, including but not limited to at least one of metering, mixing, debubbling and dispensing. Before dispensing the amplification reaction solution into each individual detection well 61 of the fluidic networks 6A and 6B, the solution should be properly metered and mixed. The metering function may be achieved by using costly micropump and valves with accurate control, or through dedicated microfluidic design on the cartridge 2. In an embodiment, parts of the second chambers 41 and parts of the second channels 42 of the reaction chip 4 jointly form a metering unit. FIGS. 10 to 12 show different views of the metering unit on the reaction chip. As shown in FIGS. 10 to 12, for clarity of description, a portion of the reaction chip 4 is cut off to better illustrate the proposed on-cartridge metering function design. One basic metering unit 7 includes a storage chamber 71, at least one metering chamber 72, an overflow chamber 73, and channels 74 connecting these chambers 71, 72 and 73. The storage chamber 71 is adapted to contain the reagent to be metered. The metering chamber 72 is structured on the reaction chip 4 with certain volume, and its footprint shape may be but not limited to round, square, triangle, rectangle, hexagon, oval, etc. The chambers 71, 72 and 73 and channels 74 are enclosed with a pressure sensitive adhesive (PSA) tape or sealed with a plastic film by thermal bonding or heat seal. When certain amount of the stored reagent needs to be metered, the reagent in the storage chamber 71 may be pumped into the connected channel 74 and the metering chamber 72. After complete filling of the metering chamber 72, excess reagent will flow into the overflow chamber 73. The contained reagent in the metering chamber 72 is then pumped out for further processing. This metering design is very cost-effective, because it is not needed to embed valves in the cartridge 2 or to accurately control external micropump with on-line feedback from precise pressure sensors.

One basic metering unit 7 is used for metering one type of reagent, but the number of metering chamber 72 in one metering unit 7 may be two or more on demand. In some embodiments, as shown in FIGS. 10 to 12, there are one small metering chamber 721 and one large metering chamber 722 connected in series. The two metering chambers 721 and 722, for example, may meter different amount master mix for the sample detection wells 61 of the fluidic network 6A and the control detection wells 61 of the fluidic network 6B separately. The storage chamber 71 is connected to the first metering chamber 721 through the fluidic channels 741, 742, and 743, the first metering chamber 721 is connected to the second metering chamber 722 through the fluidic channel 744, and the second metering chamber 722 is connected to the overflow chamber 73 through the fluidic channel 745. Further, four pneumatic channels 751 to 754 are connected to the storage chamber 71, the first metering chamber 721, the second metering chamber 722, and the overflow chamber 73, respectively, for driving the flow of the liquid in the metering unit 7.

This design may be used to meter reagent with volume 20 μL to 1 mL, and the estimated metering tolerance in percentage may be less than 5%. The estimation is based on the analysis shown in the Table 1 below.

TABLE 1

| | | | Channel volume (μL) and effects | | | | | |
|---|---|---|---|---|---|---|---|---|
| Metering tolerance estimation (%) | | | 743 1.69 | 752 0.79 | 744 1.29 | 745 1.29 | 753 0.79 | % Variance |
| Chamber volume (μL) | 721 | 40 | – | ++ | – | | | <4.5% |
| | 722 | 110 | | | – | – | ++ | <2.5% |

As shown in Table 1, the volumes of the metering chambers 721 and 722 are 40 μL and 110 μL, respectively, and the residual liquid volumes in channels 743, 752, 744, 745, and 753 are 1.69 μL, 0.79 μL, 1.29 μL, 1.29 μL, and 0.79 μL, respectively. The major reason for metering inaccuracy is due to the dead volume in the planar channels connected to the metering chambers 721 and 722. As shown in FIG. 11, there are three channels connected to each of the metering chambers 721 and 722. The fluidic channels 743, 744, and 745 have negative effect on metering volume, while the pneumatic channels 752 and 753 have positive effect on the metering volume. There are several rule-of-thumbs for properly designing channels and chambers to reduce metering inaccuracy. The dimension of the pneumatic channels 752 and 753 may be at least two times smaller than the dimension of the fluidic channels 743, 744, and 745, to prevent reagent flowing into the pneumatic channels 752 and 753 and to reduce the risk of contamination to the diagnostic system. The dimension of the fluidic channels 743, 744, and 745, within manufacturing capability, may be as small as possible, in order to reduce the negative effect on metering volume. In order to assure complete filling of metering chambers 721 and 722, it is preferred to design the diameter of the metering chambers 721 and 722 no less than 4 times of the width of the connecting fluidic channels 743, 744, and 745, and to keep the diameter-to-height ratio of metering chambers 721 and 722 to be less than 1. In some other embodiments, relatively hydrophilic cartridge material, or surface modification on the metering chamber walls, or hydrophilic pressure sensitive adhesive (PSA) tape sealed onto the reaction chip 4, may also ensure complete filling of the metering chambers 721 and 722. In some embodiments, the storage chamber 71, the metering chamber 72, and the overflow chamber 73 may be any shape, including but not limited to round, square, triangle, rectangular or oval.

Mixing and debubbling are another two important fluidic functions to properly prepare amplification reaction solutions, especially for handling viscous reagent and reagent with bubbly detergent. For example in some embodiments, liquid form enzyme glycerol solution and master mix componential buffers are separately stored in the cartridge, and they need to be premixed thoroughly on demand. However, the enzyme glycerol solution normally contains very high ratio of viscous glycerol, e.g. 50%, which may prevent complete freezing at −20 degree Celsius, avoid protein denaturation and preserve enzymatic activity. It is quite challenging to achieve uniform mixture of the enzyme glycerol solution and the master mix componential buffers. There are several practical mixing methodologies, including mechanical disturbance by impeller or magnetic bar, thermo-dynamic mixing, electro-hydrodynamic mixing, ultrasonic mixing, etc. These methods are either costly or complicated to implement in the cartridge. Moreover, when handling the reagent with bubbly detergent, it is very difficult and tedious to eliminate the generated bubbles during mixing. The present disclosure provides a cheap, simple but effective mixing and debubbling method without special structure design and complex control. Mixing of reagents, especially those challenging reagents, may be realized by bubble agitation in the mixing chamber. With an additional ball contained in the mixing chamber, the reagents may be mixed more efficiently, and the caused bubbles may be eliminated from the mixture thereafter.

Figure 13:
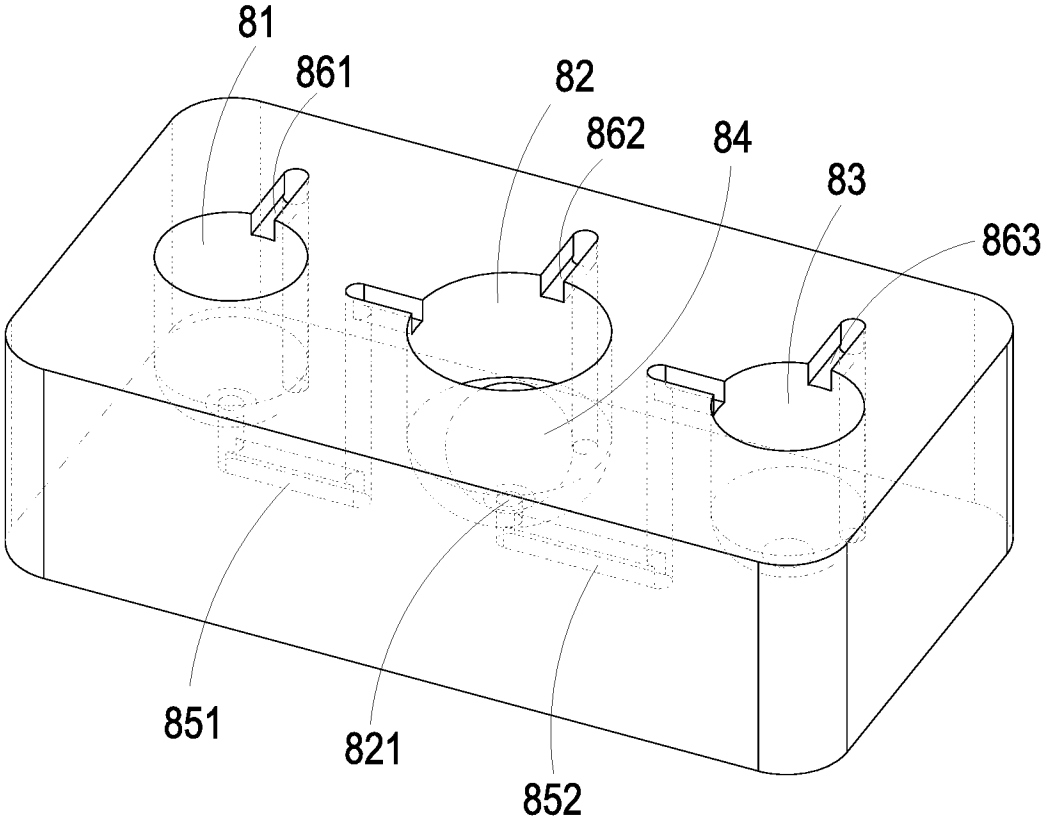
FIGS. 13 and 14 show different views of the mixing and debubbling unit on the reaction chip.
Figure 14:
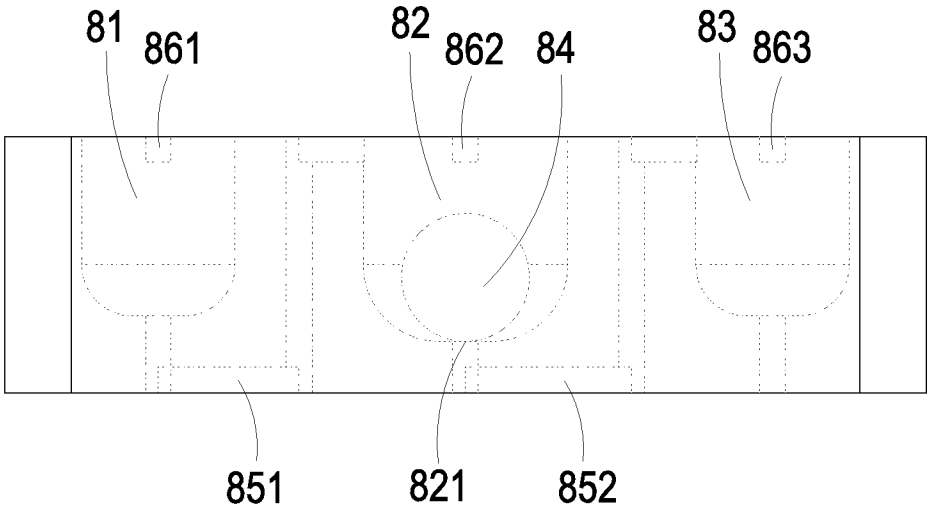
Figure 15B:
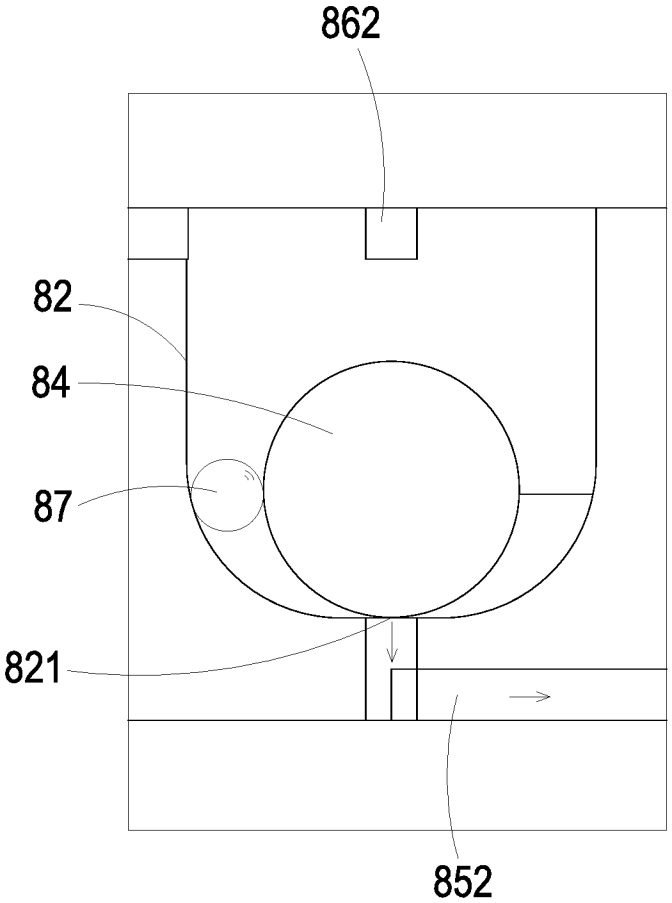
FIGS. 15A and 15B show schematic views of mixing and debubbling working mechanism.
Figure 15A:
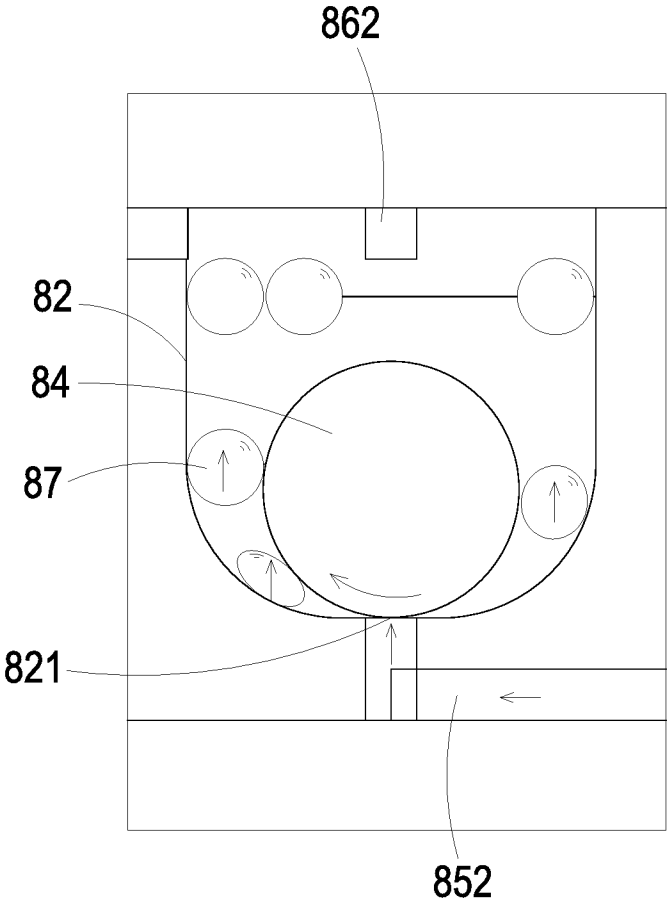

In an embodiment, parts of the second chambers 41 and parts of the second channels 42 of the reaction chip 4 jointly form a mixing and debubbling unit. FIGS. 13 and 14 show different views of the mixing and debubbling unit on the reaction chip, and FIGS. 15A and 15B show schematic views of the mixing and debubbling working mechanism. As shown in FIGS. 13 and 14, for clarity of description, a portion of the reaction chip 4 is cut off to better illustrate the proposed on-cartridge mixing and debubbling function design. One typical mixing and debubbling unit 8 includes at least a storage chamber 81, a mixing chamber 82, a mixture chamber 83, a ball 84 contained in the mixing chamber 82, and channels 851 and 852 connecting these chambers 81, 82, and 83. The storage chamber 81 is connected to the mixing chamber 82 through the fluidic channel 851, and the mixing chamber 82 is connected to the mixture chamber 83 through the fluidic channel 852. Further, three pneumatic channels 861 to 863 are connected to the storage chamber 81, the mixing chamber 82, and the mixture chamber 83, respectively, for driving the flow of the liquid in the mixing and debubbling unit 8. The ball 84 contained in the mixing chamber 82 may be biocompatible to reaction reagents, and have a density higher than the reagents to be mixed. For example, the ball 84 is made of or coated with a layer of a biocompatible material. In some embodiments, the mixing chamber 82 may also be used as the storage chamber to store one reagent to mix. When the reagents are delivered into the mixing chamber 82 through the fluidic channel 851, the ball 84 functions as a single-direction valve to block a bottom hole 821 of the mixing chamber 82, and minimize reagent loss into the fluidic channel 852.

Mixing of reagents may be realized by bubble agitation in the mixing chamber 82, as illustrated in FIG. 15A. The bubbles 87 may be generated by pumping air into the mixing chamber 82 through the fluidic channel 852 at the bottom of the mixing chamber 82. Or in another embodiment, a capillary tube may be inserted from top with its tip immersed in the reagents, therefore air may be pumped through this capillary tube to purposely generate bubbles to agitate the mixture. When bubbles 87 are generated from the bottom hole 821, the ball 84 functions as a flow regulator, which may moderate bubble size and generation frequency. The generated bubbles 87 from the bottom hole 821 may propel the ball 84 to rotate freely in the mixing chamber 82 to disturb the mixture. Moreover, the freely rotatable ball 84 may generate random directional distribution of the bubbles 87 jetting into the mixture, which may generate more complex vortices in the mixture to enhance more efficient mixing. The effect of the generated bubbles 87 on mixing efficiency is more significant than that of the rotatable ball 84. The generation of the bubbles 87 is controllable by tuning micropump parameters.

Figure 16:
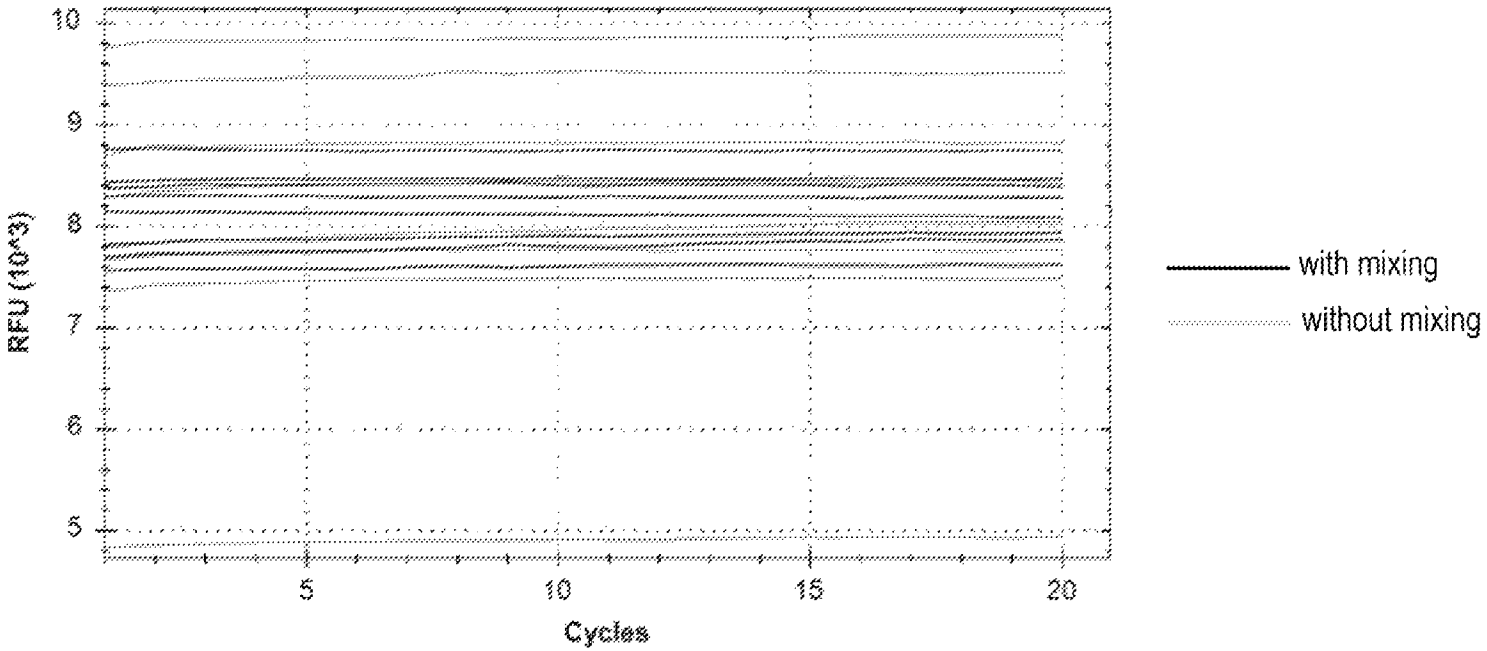
FIG. 16 shows a mixing result measurement.

FIG. 16 shows a mixing result measurement. In an embodiment of mixing test, three different liquids, 138 μL nuclease free water, 150 μL master mix (excluding enzyme) with fluorescent dye FAM, and 12 μL viscous enzyme glycerol solution were delivered into the mixing chamber 82 in the reaction chip 4. Bubbles 87 were generated from the bottom hole 821 of the mixing chamber 82 with proper control on micropump. After a period of time (a few to tens of seconds), 25 μL of mixture was pipetted out for 8 times from different liquid layers and contained in strip tubes for fluorescence intensity measurement. Reference strip tubes contained mixture without bubble agitation mixing. It is obvious that with bubble agitation, mixing efficiency in terms of fluorescent intensity uniformity was significantly better than that without mixing. With proper control over pumping pressure or flow rate, mixing efficiency may be verified through but not limited to above mentioned measurement method.

Some of the generated bubbles floating on the mixture surface tend to collapse, but when surfactant or detergent, e.g. Tween and NP40, is used in the reagents, surface tension effects make it difficult to break bubbles naturally. Compared to practical benchtop methods, e.g. centrifugation and membrane filtration, it is challenging to eliminate bubbles in an all-in-one point-of-care cartridge. In this disclosure, a simple but effective debubbling method is proposed to address this issue, and its working mechanism is illustrated in FIG. 15B. Air is pumped through the pneumatic channel 862 from top to push the mixture downwards. The ball 84 laying at the bottom tends to block the bottom hole 821 and hold all the mixture in the mixing chamber 82, therefore the air in the mixing chamber 82 will be pressurized gradually, which results in collapse of the generated bubbles 87. Moreover, when the pressure in the mixing chamber 82 reaches certain level, the high pressure will push and squeeze the mixture into the fluidic channel 852 from the tiny gaps between the ball 84 and the bottom hole 821. In this process, the high surface tension of mixture (e.g. master mix), and any controlled geometry dimensional tolerance or uncontrollable surface machining imperfection, will facilitate the mixture flowing out into the fluidic channel 852. Thereafter, the chamber pressure decreases, and the mixture stops flowing out, and the chamber air starts to be pressurized again. This dynamic process continues until all the liquid is pushed into the fluidic channel 852.

In some embodiments, the ball 84 may be made of a high density material, such as polytetrafluoroethylene (PTFE) or Titanium alloy, but not limited thereto. In some embodiments, the ball 84 may be coated with a layer of a biocompatible material. In some embodiments, the biocompatible material may include at least one of polytetrafluoroethylene (PTFE), polypropylene (PP), titanium alloy, and a combination thereof, but not limited thereto.

In some embodiments, the mixing duration may be shorter than 10 s, and the debubbling process is about 1 min, but not limited thereto.

In some embodiments, the reaction chip 4 may be chemically treated with hydrophobic or hydrophilic coatings for a particular fluidic function (e.g. controlled wetting) or biocompatibility purpose (e.g. low or no DNA binding).

In some embodiments, the reaction chip 4 may be manufactured by using but not limited to computer numerical control (CNC) machining, 3D printing (additive manufacturing), hybrid manufacturing, injection molding, hot embossing, laser ablation, thermoforming, photolithography, soft lithography, casting or any combinations of the above-mentioned.

In some embodiments, the planar portion 43 of the reaction chip 4 may be directly attached to thermal components for one-sided or two-sided heating and cooling, during amplification and detection. In other embodiments, the planar portion 43 of the reaction chip 4 may be heated through non-contact approaches, such as air convection, heat dissipation, infrared heating, microwave heating or laser heating, but not limited hereto.

Figure 17:
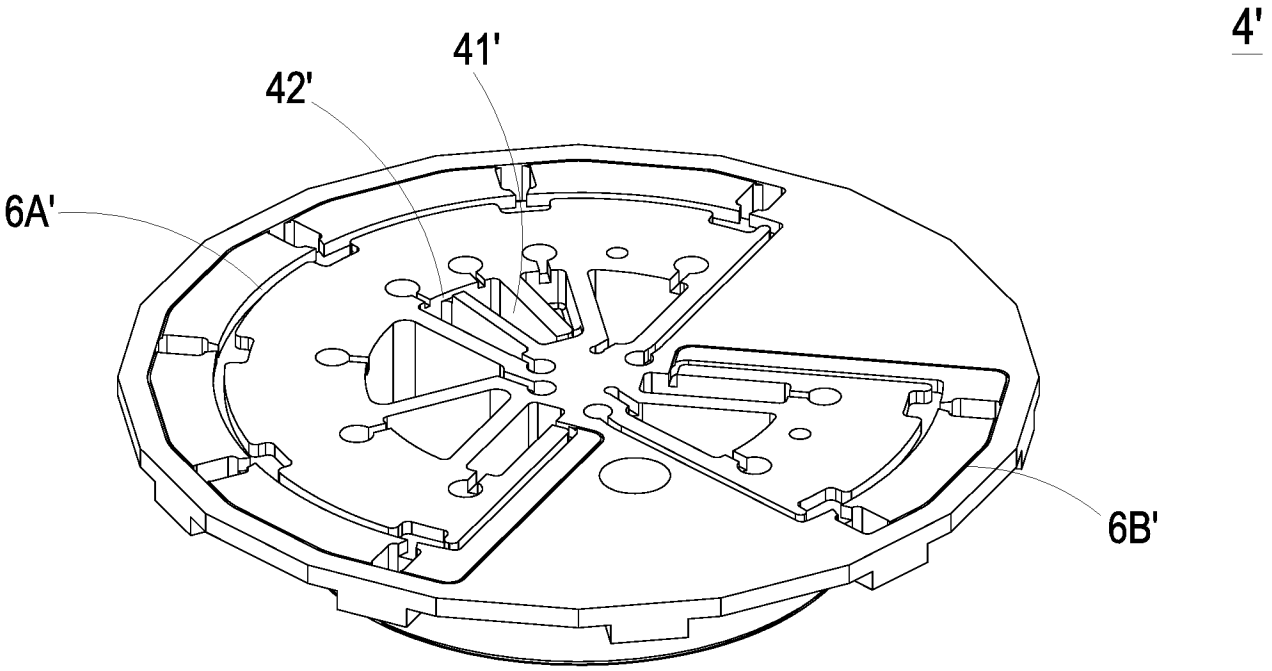
FIGS. 17 to 19 show different views of the reaction chip of the cartridge according to another embodiment of the present disclosure.
Figure 18:
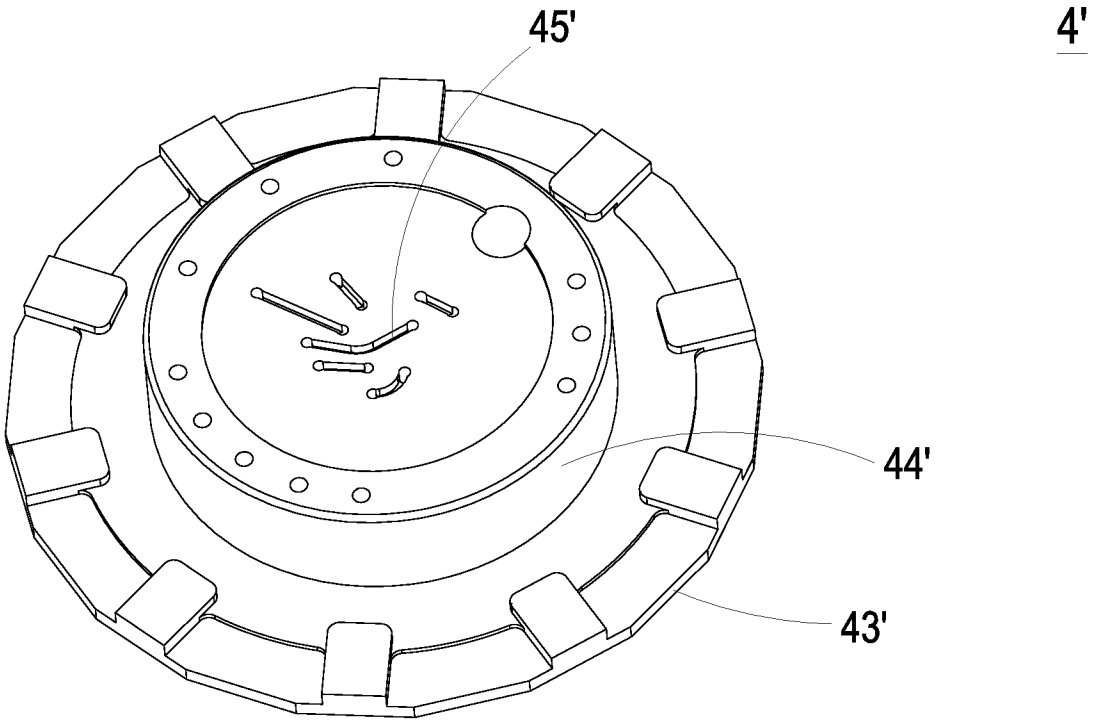
Figure 19:
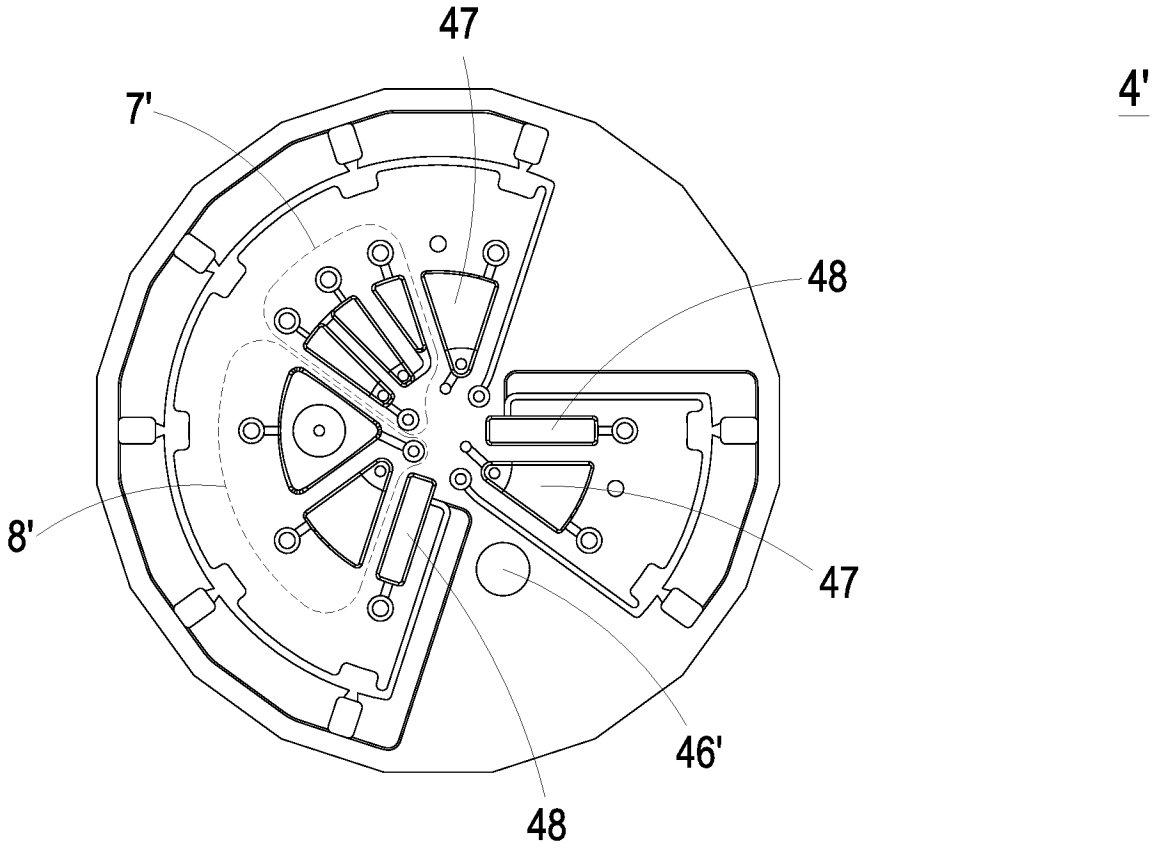

FIGS. 17 to 19 show different views of the reaction chip of the cartridge according to another embodiment of the present disclosure. Similar to the reaction chip 4 shown in FIGS. 3 to 6, the reaction chip 4' shown in FIGS. 17 to 19 also includes the plural second chambers 41', the plural second channels 42', the at least two fluidic networks 6A' and 6B', the planar portion 43', the column portion 44', the bottom openings 45', and the sample loading port 46'. The main difference between the reaction chip 4 and the reaction chip 4' is the chamber geometry. As shown in FIG. 19, the reaction chip 4' includes the storage chambers 47, the waste chambers 48, the metering unit 7', and the mixing and debubbling unit 8'. Due to the shapes and the distributions of the chambers, the reaction chip 4' has even wall thickness, so that the manufacturing cost of the reaction chip 4' may be reduced.

In some embodiments, the cartridge 2 further includes a thermal treatment chip 5, as shown in FIG. 3. The thermal treatment chip 5 is in conjunction with the cartridge body 3; for example, it is disposed at the bottom of the cartridge body 3. The thermal treatment chip 5 may be disc-shaped, and the diameter of the thermal treatment chip 5 may be substantially the same as that of the cartridge body 3. The thermal treatment chip 5 may be pre-assembled with the conjunct cartridge body 3 during mass production, by using but not limited to snap fitting, thermal bonding, solvent bonding, adhesive bonding, ultrasonic bonding, laser welding, or any combinations of the above-mentioned.

The thermal treatment chip 5 may include at least one of a fluidic chamber and a channel, in conjunction with an external heating unit disposed in the chamber 121 of the main frame 12 of the nucleic acid analysis apparatus 1 for thermal treatment of nucleic acid extracted from the sample, e.g. 95 degree Celsius heating for a period of time, to denature double-stranded deoxyribonucleic acid (DNA) extracted from the sample, in order to subsequently improve the amplification performance. Thus, after the nucleic acid extraction is completed in the cartridge body 3, the sample with extracted nucleic acid may be first delivered down to the thermal treatment chip 5 for denaturation, and then delivered up to the reaction chip 4 for nucleic acid amplification and detection. Therefore, the nucleic acid analysis apparatus 1 is not limited to be applied to isothermal based amplification, and may provide a second temperature zone for denaturation to improve the amplification performance. In addition, the nucleic acid analysis apparatus 1 may also be applied to the amplification techniques which require thermal cycling, such as polymerase chain reaction (PCR).

In other words, in one embodiment, the cartridge 2 may be divided into three parts according to practical cartridge function requirements. The three parts include the reaction chip 4 (top part), the cartridge body 3 (middle part), and the thermal treatment chip 5 (bottom part). The reaction chip 4 may be for at least one of nucleic acid amplification reagent storage, reaction solution processing (e.g. metering, mixing, debubbling and dispensing), nucleic acid amplification, and detection. The cartridge body 3, also referred as extraction chip, may be for at least one of sample storage, sample preparation reagent storage, sample cell lysis, nucleic acid extraction, and purification. The thermal treatment chip 5 may be for nucleic acid denaturation. Among which, the thermal treatment chip 5 may be a supplemental structure, which is equipped on demand.

It is obvious that the cylindrical cartridge body in the embodiment of the present disclosure has been sliced horizontally into at least two portions, including the reaction chip 4 and the cartridge body 3. The reaction chip 4 is capable of containing reaction solutions in detection wells 61 for both sample detection and on-cartridge quality control. Moreover, the reaction chip 4 is capable of processing and preparing the reaction solutions before dispensing into the detection wells 61, e.g., metering, mixing and debubbling. Further, some sensitive reagents may be stored separately from those non-sensitive reagents in different cartridge portions, so that the cartridge portions containing different reagents may be stored at different temperatures according to particular reagent storage requirements. In addition, since the cylindrical cartridge body in the embodiment of the present disclosure has been sliced horizontally into at least two portions, there is no extra high aspect-ratio through-hole channel in the cartridge, and thus the production by injection molding is more achievable.

In conclusion, the embodiment of the present disclosure provides a flow control and processing cartridge used in a nucleic acid analysis apparatus. The cartridge includes the reaction chip and the cartridge body, so that different reagents contained in the two portions may be stored at different temperatures according to particular reagent storage requirements. The reaction chip includes at least two fluidic networks for nucleic acid amplification and/or detection, wherein one of the at least two fluidic networks is configured for quality control, and thus the cartridge provides on-cartridge processing quality assurance. Further, the reaction chip includes the metering unit and the mixing and debubbling unit, so as to perform various fluidic functions in fluidic processing. Moreover, the reaction chip has well-designed channel geometry to precisely control the flow direction and dynamic flow behaviors within the reaction chip, so that the sample could be sequentially and smoothly dispensed to each detection well for facilitating the following nucleic acid amplification and detection. Further, due to the arrangements of multiple detection wells, both multiple-well multiplexing nucleic acid analysis and multiple color multiplexing detection may be achieved, and the sample throughput flexibility may also be achieved. In addition, the cartridge has better machinability since there is no extra high aspect-ratio through-hole channels in the cartridge. Besides, the cartridge may include a thermal treatment chip used for denaturing double-stranded DNA in order to improve the amplification performance.

While the invention has been described in terms of what is presently considered to be the practical and preferred embodiments, it is to be understood that the invention needs not be limited to the disclosed embodiment. On the contrary, it is intended to cover various modifications and similar arrangements included within the spirit and scope of the appended claims, which are to be accorded with the broadest interpretation so as to encompass all such modifications and similar structures.

What is claimed is:

1. A flow control and processing cartridge used in a nucleic acid analysis apparatus, comprising:

a cartridge body comprising plural first chambers and plural first channels connected with the plural first chambers for storing and processing at least one of at least one sample, at least one reagent, and at least one buffer and configured to perform at least one of sample purification and nucleic acid extraction; and a reaction chip in conjunction with the cartridge body and comprising:

plural second chambers and plural second channels connected with the plural second chambers configured to store and process at least one amplification reaction solution; and at least two fluidic networks configured to perform nucleic acid amplification and detection, wherein at least one of the fluidic networks comprises plural detection wells, a main fluid channel connected with the detection wells and configured to dispense the sample or control liquids into the detection wells, and a gas releasing channel connected with the detection wells and configured to release gas from the detection wells, wherein one of the fluidic networks is configured for quality control.

2. The flow control and processing cartridge according to claim 1, wherein the control liquids include a positive control liquid and a negative control liquid.

3. The flow control and processing cartridge according to claim 1, wherein parts of the second chambers and parts of the second channels of the reaction chip jointly form a metering unit.

4. The flow control and processing cartridge according to claim 3, wherein the metering unit comprises a storage chamber, at least one metering chamber, an overflow chamber, and channels connecting the storage chamber, the metering chamber, and the overflow chamber.

5. The flow control and processing cartridge according to claim 1, wherein parts of the second chambers and parts of the second channels of the reaction chip jointly form a mixing and debubbling unit.

6. The flow control and processing cartridge according to claim 5, wherein the mixing and debubbling unit comprises a storage chamber, a mixing chamber, a mixture chamber, a ball contained in the mixing chamber, and channels connecting the storage chamber, the mixing chamber, and the mixture chamber.

7. The flow control and processing cartridge according to claim 6, wherein the mixing chamber has a bottom hole, and the ball lays on the bottom hole as a single-direction valve to block the bottom hole when the at least one amplification reaction solution is delivered into the mixing chamber.

8. The flow control and processing cartridge according to claim 6, wherein the ball is made of or coated with a layer of a biocompatible material.

9. The flow control and processing cartridge according to claim 6, wherein a mixing function of the mixing and debubbling unit is implemented by pumping air into the amplification reaction solution contained in the mixing chamber to agitate the amplification reaction solution.

10. The flow control and processing cartridge according to claim 6, wherein a debubbling function of the mixing and debubbling unit is implemented by pumping air into the mixing chamber to pressurize the air and break bubbles in the amplification reaction solution.

11. The flow control and processing cartridge according to claim 1 further comprising a thermal treatment chip in conjunction with the cartridge body.

12. The flow control and processing cartridge according to claim 1, wherein the gas releasing channel is much narrower than the main fluid channel.

13. The flow control and processing cartridge according to claim 1, wherein the main fluid channel comprises plural wide channel parts, plural narrow channel parts, and plural well inlet channels.

14. The flow control and processing cartridge according to claim 13, wherein each of the plural wide channel parts is aligned with one of the plural detection wells and connected with the corresponding detection well through the corresponding well inlet channel, and each of the plural narrow channel parts is connected between two adjacent wide channel parts.

15. The flow control and processing cartridge according to claim 14, wherein a flow resistance at the narrow channel part is higher than a combined flow resistance at the wide channel part and at the well inlet channel.

16. The flow control and processing cartridge according to claim 14, wherein the well inlet channel has lower flow resistance on one end connected with the detection well and higher flow resistance on the other end far away from the detection well.

17. The flow control and processing cartridge according to claim 1, wherein the reaction chip comprises a planar portion and a column portion, and the column portion is extended from a bottom of the planar portion and has a smaller cross-section than the planar portion.

18. The flow control and processing cartridge according to claim 1, wherein the reaction chip further comprises at least one sample loading port for adding the sample into the cartridge.

19. The flow control and processing cartridge according to claim 1, wherein the reaction chip further comprises plural sample loading ports for adding different samples into the cartridge.

20. The flow control and processing cartridge according to claim 1, wherein the detection well comprises at least one light transmissive thin wall or thin film for passing light therethrough.

* * * * *